US011000968B2

(12) United States Patent
Mikoshiba et al.

(10) Patent No.: US 11,000,968 B2
(45) Date of Patent: May 11, 2021

(54) SHEET MANUFACTURING APPARATUS AND METHOD FOR CONTROLLING SHEET MANUFACTURING APPARATUS

(71) Applicant: SEIKO EPSON CORPORATION, Tokyo (JP)

(72) Inventors: Takao Mikoshiba, Nagano (JP); Yoshinobu Monbetsu, Nagano (JP); Yasumasa Nakajima, Nagano (JP); Seiichi Taniguchi, Nagano (JP); Takeshi Kimoto, Chiba (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 16/328,317

(22) PCT Filed: Aug. 2, 2017

(86) PCT No.: PCT/JP2017/028108
§ 371 (c)(1),
(2) Date: Feb. 26, 2019

(87) PCT Pub. No.: WO2018/043017
PCT Pub. Date: Mar. 8, 2018

(65) Prior Publication Data

US 2019/0193296 A1 Jun. 27, 2019

(30) Foreign Application Priority Data

Aug. 31, 2016 (JP) ..... JP2016-169796

(51) Int. Cl.
*B27N 3/04* (2006.01)
*D04H 1/413* (2012.01)
(Continued)

(52) U.S. Cl.
CPC ..... *B27N 3/04* (2013.01); *D04H 1/413* (2013.01); *D04H 1/732* (2013.01); *B27N 3/002* (2013.01)

(58) Field of Classification Search
USPC ..... 162/162, 263
See application file for complete search history.

(56) References Cited

U.S. PATENT DOCUMENTS 10,350,784 B2 7/2019 Murayama et al.
2006/0008621 A1 1/2006 Gusky et al.
(Continued)

FOREIGN PATENT DOCUMENTS

JP 07-313863 A 12/1995
JP 2001-011795 A 1/2001
(Continued)

*Primary Examiner* — Mark Halpern
(74) *Attorney, Agent, or Firm* — Global IP Counselors, LLP

(57) ABSTRACT

There is provided a sheet manufacturing apparatus that is capable of manufacturing a sheet having a predetermined color, the apparatus including: a plurality of resin cartridges that store a plurality of colored resins, respectively; a resin supply unit that supplies a resin from one or the plurality of resin cartridges to a predetermined raw material in a predetermined step of manufacturing a sheet; and a controller that selects a resin cartridge, which is a supply source of a resin, when the resin supply unit supplies the resin, and performs setting related to a supply amount of a resin for each of the selected resin cartridges, based on setting related to a color of a sheet to be manufactured.

9 Claims, 19 Drawing Sheets

(51) Int. Cl.
*D04H 1/732* (2012.01)
*B27N 3/00* (2006.01)

(56) References Cited

U.S. PATENT DOCUMENTS

| | | | |
|---|---|---|---|
| 2014/0271966 | A1 | 9/2014 | Giloh et al. |
| 2016/0047075 | A1 | 2/2016 | Foley et al. |
| 2016/0230320 | A1 | 8/2016 | Ueno et al. |
| 2016/0332325 | A1 | 11/2016 | Murayama et al. |

FOREIGN PATENT DOCUMENTS

| | | | |
|---|---|---|---|
| JP | 2008-137332 | A | 6/2008 |
| JP | 2013-091265 | A | 5/2013 |
| JP | 2015-092032 | A | 5/2015 |
| JP | 2015-209600 | A | 11/2015 |
| JP | 2016-517480 | A | 6/2016 |
| JP | 4016-517480 | A | 6/2016 |
| WO | 2015/128912 | A1 | 9/2015 |
| WO | 2017/082217 | A1 | 5/2017 |

FIG. 14

TB1

R1

| (Y, M, C) | FIRST UNCOLORED COLOR | SECOND UNCOLORED COLOR | WHITE | YELLOW | MAGENTA | CYAN |
|---|---|---|---|---|---|---|
| (1, 0, 0) | 60% | 50% | 0% | 10% | 0% | 0% |
| (0, 1, 0) | 60% | 50% | 0% | 0% | 10% | 0% |
| (0, 0, 1) | 60% | 50% | 0% | 0% | 0% | 10% |
| ⋮ | ⋮ | ⋮ | ⋮ | ⋮ | ⋮ | ⋮ |
| (2, 2, 2) | 60% | 0% | 0% | 20% | 20% | 20% |
| ⋮ | ⋮ | ⋮ | ⋮ | ⋮ | ⋮ | ⋮ |
| (3, 1, 1) | 70% | 0% | 0% | 30% | 10% | 10% |
| ⋮ | ⋮ | ⋮ | ⋮ | ⋮ | ⋮ | ⋮ |
| (4, 4, 4) | 0% | 0% | 0% | 40% | 40% | 40% |

FIG. 15

TB2

| WHITE VALUE | FIRST UNCOLORED COLOR | SECOND UNCOLORED COLOR | WHITE | YELLOW | MAGENTA | CYAN |
|---|---|---|---|---|---|---|
| 0 | 60% | 60% | 0% | 0% | 0% | 0% |
| 1 | 50% | 50% | 20% | 0% | 0% | 0% |
| 2 | 40% | 40% | 40% | 0% | 0% | 0% |
| 3 | 30% | 30% | 60% | 0% | 0% | 0% |
| 4 | 20% | 20% | 80% | 0% | 0% | 0% |

R2

SHEET MANUFACTURING APPARATUS AND METHOD FOR CONTROLLING SHEET MANUFACTURING APPARATUS

CROSS-REFERENCE TO RELATED APPLICATIONS

This application is a U.S. National stage application of International Patent Application No. PCT/JP2017/028108, filed on Aug. 2, 2017, which claims priority under 35 U.S.C. § 119(a) to Japanese Patent Application No. 2016-169796, filed in Japan on Aug. 31, 2016. The entire disclosure of Japanese Patent Application No. 2016-169796 is hereby incorporated herein by reference.

TECHNICAL FIELD

The present invention relates to a sheet manufacturing apparatus and a method for controlling the sheet manufacturing apparatus.

BACKGROUND ART

In the related art, regarding a sheet manufacturing apparatus that manufactures a sheet, a technology is known, in which a resin (a complex that has a resin and a coloring material integrally) and a material (fiber) is mixed (for example, see Japanese Unexamined Patent Application Publication No. 2015-92032).

Here, in Japanese Unexamined Patent Application Publication No. 2015-92032, there is no description of executing a step of mixing one or a plurality of colored resins and a material in order to manufacture a sheet having a predetermined color. In this manner, in a case of a sheet manufacturing apparatus that executes a step of mixing one or a plurality of colored resins and a material, it is necessary to perform an appropriate resin supply such that it is possible to manufacture a sheet having a predetermined color.

SUMMARY

The present invention is made with consideration for such a circumstance, and an object thereof is to provide a sheet manufacturing apparatus that is capable of manufacturing a sheet having a predetermined color, in which an appropriate resin supply is performed in a step of mixing a material and one or a plurality of colored resins.

In order to solve such a problem described above, in the present invention, there is provided a sheet manufacturing apparatus that is capable of manufacturing a sheet having a predetermined color, the apparatus including: a plurality of resin cartridges that store a plurality of colored resins, respectively; a resin supply unit that supplies a resin from one or the plurality of resin cartridges to a predetermined raw material in a predetermined step of manufacturing a sheet; and a controller that selects one from the resin cartridges, which are supply sources of resins, when the resin supply unit supplies the resin, and performs setting related to a supply amount of a resin for each of the selected resin cartridges, based on setting related to a color of a sheet to be manufactured.

According to the present invention, the controller selects the resin cartridge that supplies the resin and performs setting related to the supply amount of the resin based on the setting related to the color of the sheet to be manufactured, the resin is supplied based on the setting, and thereby it is possible to perform an appropriate resin supply in a step of mixing a raw material and one or the plurality of colored resins.

In the present invention, the sheet manufacturing apparatus further includes: an uncolored resin cartridge that stores an uncolored resin which is an uncolored resin; and a colored resin cartridge that stores a colored resin which is a resin that is colored. The controller selects the uncolored resin cartridge and the colored resin cartridge together as targets of the resin cartridges of the supply sources of the resins.

According to the present invention, the sheet manufacturing apparatus is capable of mixing the uncolored resin and the raw material properly so as to manufacture the sheet appropriately during manufacture of the sheet having the predetermined color.

In the present invention, when performing setting related to the supply amount of the resin for each of the selected resin cartridges, the controller determines a total supply amount of all of the resins such that a ratio of a total supply amount of all of the resins to a weight of the predetermined raw material does not exceed a first threshold value.

According to the present invention, in a case where a sheet of colored paper is manufactured, it is possible to perform an appropriate resin supply in a step of mixing the raw material and the one or plurality of colored resins.

In the present invention, the controller determines, as a supply amount of the uncolored resin, an amount corresponding to a difference between the determined total supply amount of all of the resins and a total of the determined supply amounts of the colored resins having respective colors.

According to the present invention, in a case where a sheet of colored paper is manufactured, it is possible to perform an appropriate resin supply in a step of mixing the raw material and the one or plurality of colored resins.

In the present invention, the controller displays a user interface for performing setting related to a color of a sheet to be manufactured.

According to the present invention, a user can use the user interface so as to conduct setting related to the color of the sheet to be manufactured, with ease and accuracy.

In the present invention, the controller displays the user interface that has an operation object for adjusting the supply amount for each color of the colored resin cartridges, and selects one from the resin cartridges, which are the supply sources of the resins, when the resin supply unit supplies the resin, and performs setting related to a supply amount of a resin for each of the selected resin cartridges, based on an operation performed through the operation object.

According to the present invention, the user operates the operation object, and thereby it is possible to adjust the supply amount for each of the resin cartridges corresponding to the colored resins and performs setting related to the color of the sheet to be manufactured, with ease and accuracy.

In the present invention, the controller does not display the operation object for adjusting the supply amount of the uncolored resin in the user interface.

According to the present invention, information about the uncolored resin is not displayed in the user interface, and thereby it is possible not to provide the user with unnecessary information about a color that does not need to be set by the user.

In the present invention, the controller displays the user interface that has an operation object for displaying a selectable color of the sheet to be manufactured, selects one from the resin cartridges, which are the supply sources of the resins, when the resin supply unit supplies the resin, and performs setting related to the supply amount of the resin for each of the selected resin cartridges, based on an operation performed through the operation object.

According to the present invention, the user uses the operation object so as to conduct simple work of selecting the color of the sheet to be manufactured, and thereby it is possible to conduct setting related to the color of the sheet to be manufactured, with ease and accuracy.

In the present invention, the resin supply unit has a resin conveying unit that conveys a resin to a supply destination, for each of the resin cartridges, and the controller controls the resin conveying unit based on the setting related to the supply amount of the resin for each of the resin cartridges.

According to the present invention, the controller controls the resin conveying unit so as to adjust a conveyance amount of the resin, and thereby it is possible to supply an appropriate amount of the resin based on the setting related to the supply amount of the resin.

In the present invention, the resin conveying unit has a screw feeder, and the controller controls a rotation speed of the screw feeder provided in the resin conveying unit based on the setting related to the supply amount of the resin for each of the resin cartridges.

According to the present invention, the controller is capable of supplying an appropriate amount of resin based on the setting related to the supply amount of resin by using the screw feeder.

In order to solve the problem described above, there is provided A method for controlling a sheet manufacturing apparatus that includes a plurality of resin cartridges that store a plurality of colored resins, respectively, and is capable of manufacturing a sheet having a predetermined color, the method including: selecting one from the resin cartridges, which are supply sources of resins, when the resin supply unit supplies the resin, and performing setting related to a supply amount of a resin for each of the selected resin cartridges, based on setting related to a color of a sheet to be manufactured; and supplying the resin from the selected resin cartridge, based on the setting, to a predetermined raw material in a predetermined step of manufacturing a sheet.

According to the present invention, the sheet manufacturing apparatus selects the resin cartridge that supplies the resin and performs setting related to the supply amount of the resin based on the setting related to the color of the sheet to be manufactured, the resin is supplied based on the setting, and thereby it is possible to perform an appropriate resin supply in a step of mixing a raw material and one or the plurality of colored resins.

BRIEF DESCRIPTION OF DRAWINGS

FIG. 14 is a diagram showing a first supply amount table.

FIG. 15 is a diagram showing a second supply amount table.

DESCRIPTION OF EMBODIMENTS

Hereinafter, embodiments of the present invention will be described with reference to the drawings. The embodiments to be described below do not limit content of the present invention described in CLAIMS. In addition, the entire configuration to be described below is not an essential configurational requirement of the present invention.

Figure 1:
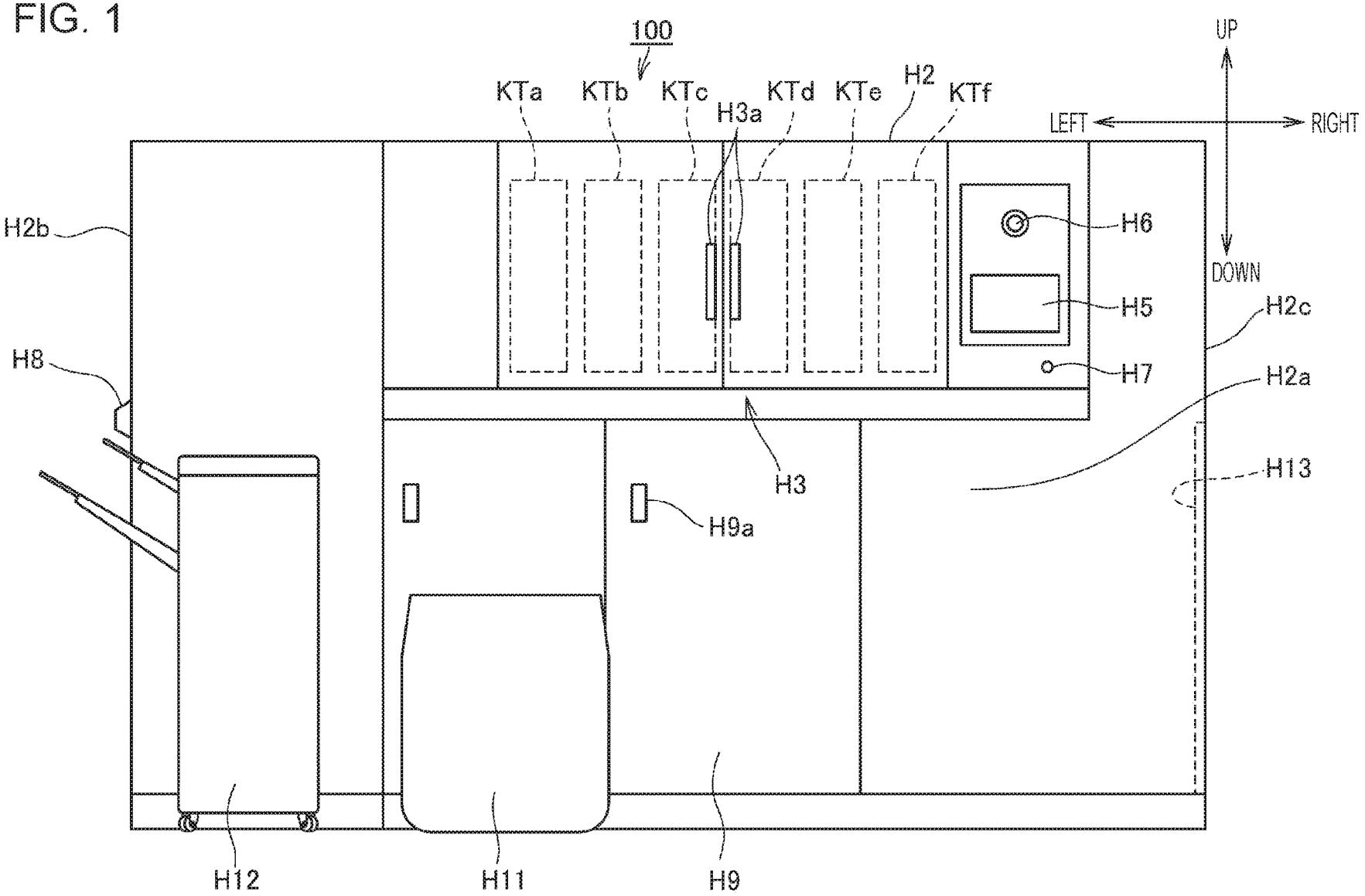
FIG. 1 is a front view of a sheet manufacturing apparatus according to the embodiment.

FIG. 1 is a front view of a sheet manufacturing apparatus 100 according to the embodiment. With reference to FIG. 1, upward, downward, right, and left directions correspond to directions represented by arrows in the drawing, respectively.

The sheet manufacturing apparatus 100 is an apparatus to which a raw material containing fibers is supplied and which processes the supplied raw material so as to manufacture a sheet having a predetermined shape and a predetermined color. In the embodiment, the raw material to be supplied to the sheet manufacturing apparatus 100 is used paper having a paper shape. However, the raw material to be supplied to the sheet manufacturing apparatus 100 is not limited to the used paper. For example, any material may be used as the raw material to be supplied to the sheet manufacturing apparatus 100 as long as the material contains fiber, and examples of the raw material include pulp, a pulp sheet, fabric containing nonwoven fabric, woven fabric, or the like.

As shown in FIG. 1, the sheet manufacturing apparatus 100 includes a substantially rectangular parallelepiped-shaped housing H2. An opening/closing door H3 is provided in an upper portion at the center of a front surface H2*a* of the housing H2 and opens and closes an opening provided in the upper portion of the front surface H2*a*. The opening/closing door H3 has a handle H3*a*, and a user uses the handle H3*a* so as to cause the opening/closing door H3 to come into an opened state or a closed state. When the opening/closing door H3 is in the opened state, a resin cartridge housing portion is exposed. The resin cartridge housing portion is a housing portion that is provided at a position inside the housing H2, the position corresponding to the opening/closing door H3, and that houses a resin cartridge KTa that stores an additive containing a first uncolored (P) resin (hereinafter, the additive containing a resin is referred to as a "resin", for descriptive purposes), a resin cartridge KTb that stores a second uncolored (S) resin, a resin cartridge KTc that stores a white (W) resin, a resin cartridge KTd that stores a yellow (Y) resin, a resin cartridge KTe that stores a magenta (M) resin, and a resin cartridge KTf that stores a cyan (C) resin. Hereinafter, in a case where the resin cartridges KTa to KTf are not distinguished from each other, the cartridges are described as the "resin cartridge KT". The first uncolored color and the second uncolored color mean colors of resins that are not subjected to coloring. The first uncolored resin has a component different from that of the second uncolored resin, and only one resin is used or both resins are mixed in a predetermined combination and used, depending on a specification of recycled paper to be manufactured. Both resins may have the same component. Components of the resins that are stored in the cartridges KT will be described below in detail.

The opening/closing door H3 is formed of a transparent material, and thus the user is able to visually recognize a state of the resin cartridge KT housed in the resin cartridge housing portion without causing the opening/closing door H3 to come into the opened state. In addition, the user causes the opening/closing door H3 to come into the opened state so as to expose the resin cartridge housing portion and, then, is able to conduct replacement of a resin cartridge KT having a predetermined color.

The resin cartridges KTa and KTb correspond to the "uncolored resin cartridges". The resin cartridges KTc to KTf correspond to the "colored resin cartridges".

As shown in FIG. 1, a touch panel H5 is provided on a right side of the opening/closing door H3, on the front surface H2*a* of the housing H2. The touch panel H5 is provided at a position at a height at which an adult user, who is assumed to operate the apparatus, is able to have visual recognition easily without changing his or her posture and is able to conduct a touch operation easily in a case where the sheet manufacturing apparatus 100 is provided in an office, a factory, or other spaces. As an example, the touch panel H5 is provided at a position at which a center portion of the touch panel H5 is positioned at a height of about 1.4 m. As will be described below, a user interface, in which various items of information about the sheet manufacturing apparatus 100 are displayed, is displayed on the touch panel H5.

As shown in FIG. 1, an emergency stop button H6 is provided above the touch panel H5, on the front surface H2*a* of the housing H2. While the sheet manufacturing apparatus 100 executes a process of manufacturing a sheet, the emergency stop button H6 is a button for an instruction of an urgent stop of the corresponding process.

As shown in FIG. 1, a push-down power switch H7 is provided below the touch panel, on the front surface H2*a* of the housing H2. In addition, a rotation type breaker switch H8 is provided in a center portion of a left surface 2*b* of the housing H2 in a vertical direction. In a state in which the sheet manufacturing apparatus 100 is not started up, the user needs to press the breaker switch H8 on and, then, press the power switch H7 on, in order to start up the sheet manufacturing apparatus 100 and cause the sheet manufacturing apparatus 100 to come into a state in which the process of manufacturing the sheet can be started.

As shown in FIG. 1, a front cover H9 is provided below the opening/closing door H3, on the front surface H2*a* of the housing H2. A handle H9*a* is provided on the front cover H9. The user uses the handle H9*a* so as to cause the front cover H9 to come into an opened state or a closed state. When the front cover H9 comes into the opened state, an in-device tank housing portion provided inside the housing H2 is exposed. The in-device tank housing portion is a housing portion that is provided at a position inside the housing H2, the position corresponding to the opening/closing door H3, and that stores at least an in-device tank. The in-device tank is a container that stores water that is supplied to a humidifier to be described below.

As shown in FIG. 1, a paper feed cassette H11 is provided in a state of projecting from the front surface H2*a*, on a lower portion of the front surface H2*a* of the housing H2. The paper feed cassette H11 is a device in which used paper is accommodated as a raw material. When a sheet is manufactured, based on the used paper, the used paper accommodated in the paper feed cassette H11 is supplied inside the housing H2 by predetermined means.

As shown in FIG. 1, the housing H2 is recessed toward a rear side, and thereby a space is formed in a left end portion of the front surface H2*a* of the housing H2. A discharge tray H12 is provided in the space. The discharge tray H12 is a device in which sheets that are manufactured by the sheet manufacturing apparatus 100 are discharged and stored in order.

As shown in FIG. 1, a waste powder box cover H13 is provided at a predetermined position on a right surface H2*c* of the housing H2. When the waste powder box cover H13 comes into an opened state, a waste powder bag housing portion provided inside the housing H2 is exposed. The waste powder bag housing portion is a housing portion that is provided at a position of the housing H2, the position corresponding to the waste powder box cover H13, and that houses at least a waste powder bag. The waste powder bag is a bag for storing waste powder generated in a predetermined step of manufacturing the sheet. The waste powder box cover H13 is capable of coming into the opened state only in a state of being unlocked by a locking mechanism (not shown).

Figure 2:
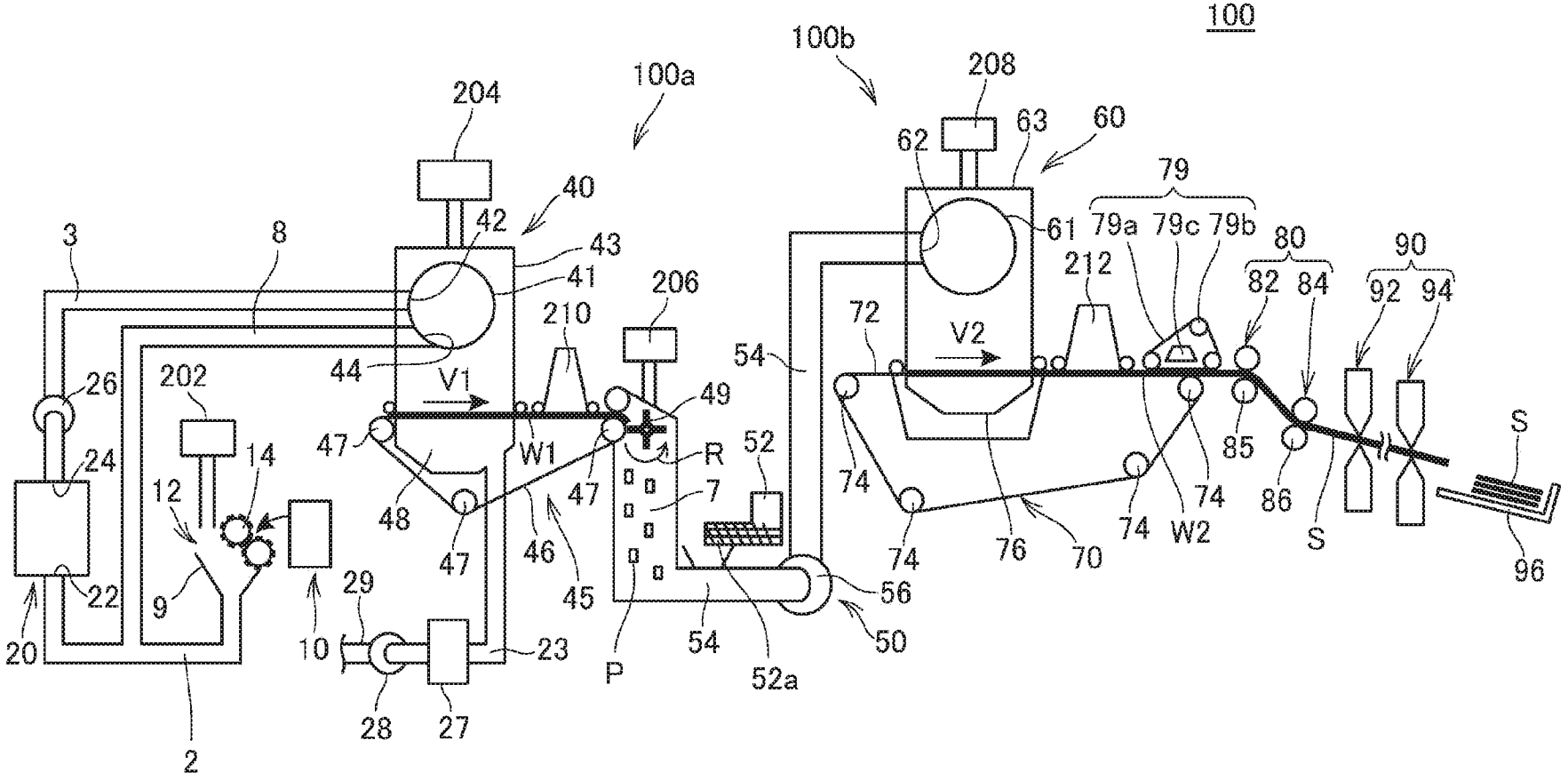
FIG. 2 is a view showing a configuration of the sheet manufacturing apparatus.

FIG. 2 is a schematic view showing a configuration of the sheet manufacturing apparatus 100.

For example, the sheet manufacturing apparatus 100 described in the embodiment is an apparatus that is suitable for defibrating used waste paper such as confidential paper as a raw material in a dry method such that the paper is fiberized and, then, manufacturing new paper through pressurization, heating, and cutting. The fiberized raw material is mixed with various additives, and thereby bond strength or a whiteness level of a paper product may improve or a function of coloring, scenting, or flame resisting may be added, depending on a use. In addition, forming is performed by controlling density, a thickness, and a shape of paper, and thereby it is possible to manufacture paper having various thicknesses or sizes, depending on a use such as office paper having an A4 or A3 size or business card paper.

As shown in FIG. 2, the sheet manufacturing apparatus 100 includes a supply unit 10, a rough crushing unit 12, a defibration unit 20, a sorting unit 40, a first web former 45, a rotary body 49, a mixer 50, an accumulation unit 60, a second web former 70, a conveying unit 79, a sheet former 80, and a cutter 90.

In addition, the sheet manufacturing apparatus 100 includes humidifying units 202, 204, 206, 208, 210, and 212 for the purpose of humidifying the raw material and/or a space through which the raw material moves. The humidifying units 202, 204, 206, 208, 210, and 212 have any specific configurations, and examples thereof include a steam type, a vaporization type, a hot air vaporization type, an ultrasound type, or the like.

In the embodiment, the humidifying units 202, 204, 206, and 208 are each configured of a vaporization-type or hot air vaporization-type humidifier. In other words, each of the humidifying units 202, 204, 206, and 208 has a filter (not shown) into which water infiltrates and causes air to pass through the filter, thereby supplying humidified air having high humidity.

In addition, in the embodiment, the humidifying unit 210 and the humidifying unit 212 are each configured of an ultrasound type humidifier. In other words, each of the humidifying units 210 and 212 has a vibrating unit (not shown), which atomizes water, and supplies mist generated by the vibrating unit.

The supply unit 10 delivers the raw material (used paper) to the rough crushing unit 12 from the paper feed cassette H11 by an operation of a paper feed motor 315 (FIG. 3) to be described below and supplies the used paper to the rough crushing unit 12.

The rough crushing unit 12 has rough crushing blades 14 that cuts (roughly crushes) the raw material supplied by the supply unit 10 into rough-crushed pieces. The rough crushing blades 14 cut the raw material in a gas atmosphere such as in the atmosphere (in the air). For example, the rough crushing unit 12 includes a pair of rough crushing blades 14, which pinches and cuts the raw material, and a drive unit, which rotates the rough crushing blades 14, and the rough crushing unit can have the same configuration as that of a so-called shredder. The rough-crushed pieces may have any shape or size as long as the shape or size is suitable for a defibrating process in the defibration unit 20. For example, the rough crushing unit 12 cuts the raw material into paper pieces having a size equal to or smaller than 1 square centimeter to several square centimeters.

The rough crushing unit 12 has a chute (hopper) 9 that receives the rough-crushed pieces which are cut by the rough crushing blades 14 and fall down. For example, the chute 9 has a tapered shape having a width that is gradually decreased in a direction (proceeding direction) in which the rough-crushed pieces flow. Therefore, the chute 16 is capable of receiving a large amount of rough-crushed pieces. A pipe 2 that communicates with the defibration unit 20 is connected to the chute 9, and the pipe 2 forms a conveying channel for conveying the raw material (rough-crushed pieces) cut by the rough crushing blades 14 to the defibration unit 20. The rough-crushed pieces are gathered by the chute 9 and are transported (conveyed) to the defibration unit 20 through the pipe 2.

The humidifying unit 202 supplies humidified air to the chute 9 or the vicinity of the chute 9 included in the rough crushing unit 12. Consequently, it is possible to suppress a phenomenon in which rough-crushed materials cut by the rough crushing blades 14 are attached to an inner surface of the chute 9 or the pipe 2 due to static electricity. In addition, the rough-crushed materials cut by the rough crushing blades 14 are transported together with humidified air (having high humidity) to the defibration unit 20, and thus it is also possible to expect an effect of suppressing attachment of a defibrated substance to an inside of the defibration unit 20. In addition, the humidifying unit 202 may be configured to supply the humidified air to the rough crushing blades 14 so as to remove electricity from the raw material that is supplied by the supply unit 10. In addition, an ionizer together with the humidifying unit 202 may remove electricity.

The defibration unit 20 performs a defibrating process on the raw material (rough-crushed pieces) cut by the rough crushing unit 12 and generates the defibrated substance. Here, "to defibrate" means to unravel fibers one by one from the raw material (defibration target object) in which a plurality of fibers are bound. The defibration unit 20 also has a function of separating a substance such as a resin grain, ink, toner, or a bleeding preventive agent, which is attached to the raw material, from the fiber.

A substance having passed through the defibration unit 20 is referred to as the "defibrated substance". The "defibrated substance" includes a resin (resin for binding a plurality of fibers to each other) grain, a coloring agent such as ink or toner, or an additive such as a bleeding preventive agent or a paper strengthening agent, which is separated from the fiber when the fiber is unraveled, in addition to an unraveled defibrated fiber, in some cases. The unraveled defibrated substance which has a string shape or a ribbon shape. The unraveled defibrated substance may be present in a state in which the substance is not intertwined with another unraveled fiber (an independent state) or may be present in a state in which the substance is intertwined with another unraveled defibrated substance into a blocking shape (a state of forming a so-called "clumps").

The defibration unit 20 performs dry defibration. Here, defibration performed through a process of defibration not in a liquid but in a gas such as in the atmosphere (in the air) is referred to as the dry defibration. In the embodiment, the defibration unit 20 is configured of an impeller mill. Specifically, the defibration unit 20 includes a rotor (not shown) that rotates at a high speed and a liner (now shown) that is positioned along an outer circumference of the roller. The rough-crushed pieces that have been roughly crushed by the rough crushing unit 12 are sandwiched between the rotor and the liner of the defibration unit 20 so as to be defibrated. The defibration unit 20 generates an air flow due to the rotation of the rotor. The air flow enables the defibration unit 20 to suction the rough-crushed pieces which are the raw material from the pipe 2 and convey the defibrated substance to a discharge port 24. The defibrated substance is delivered to a pipe 3 from the discharge port 24 and is transported to the sorting unit 40 via the pipe 3.

In this manner, the defibrated substance that is generated in the defibration unit 20 is conveyed to the sorting unit 40 from the defibration unit 20 due to the air flow that is generated by the defibration unit 20. Further, in the embodiment, the sheet manufacturing apparatus 100 includes a defibration unit blower 26 that is an air flow generating device, and the defibrated substance is conveyed to the sorting unit 40 due to the air flow generated by the defibration unit blower 26. As shown in FIG. 2, the defibration unit blower 26 is attached to the pipe 3, suctions air together with the defibrated substance from the defibration unit 20, and performs blowing to the sorting unit 40.

The sorting unit 40 is provided with an introduction port 42 into which the defibrated substance defibrated by the defibration unit 20 flows along with the air flow from the pipe 3. The sorting unit 40 sorts the defibrated substance introduced to the introduction port 42 depending on a length of fiber. To be more specific, the sorting unit 40 sorts a defibrated substance having a size equal to or smaller than a predetermined size into a first sorted substance, and a defibrated substance that is larger than the first sorted substance into a second sorted substance, of defibrated substances defibrated by the defibration unit 20. The first sorted substance includes a fiber, a grain, or the like, and a second sorted substance includes a long fiber, an incompletely defibrated piece (rough-crushed piece that is not sufficiently defibrated), a clump formed by clumping or entwining the defibrated fibers, or the like.

In the embodiment, the sorting unit 40 has a drum portion (sieve portion) 41 and a housing portion (cover portion) 43 that accommodates the drum portion 41.

The drum portion 41 is a cylinder sieve (sieve) that is rotatably driven by a motor. The drum portion 41 has a net (a filter or a screen) and functions as a sieve. The drum portion 41 sorts into the first sorted substance smaller than a size of a mesh opening (opening) of the net and the second sorted substance larger than the mesh opening of the net, by meshes of the net. Examples of the net of the drum portion 41 include a wire mesh, expanded metal obtained by expanding a metal plate provided with cuts, or punched metal provided with holes formed in a metal plate by a press machine.

The defibrated substance introduced into the introduction port 42 is delivered along with the air flow into the inside of the drum portion 41, and the first sorted substance falls downward from the mesh of the net of the drum portion 41 due to the rotation of the drum portion 41. The second sorted substance that cannot pass through the mesh of the net of the drum portion 41 flows to be guided to a discharge port 44 and is delivered to a pipe 8 along with the air flow flowing to the drum portion 41 from the introduction port 42.

The pipe 8 connects the inside of the drum portion 41 to the pipe 2. The second sorted substance flowing through the pipe 8 flows to the pipe 2 along with the rough-crushed pieces that have been roughly crushed by the rough crushing unit 12 and is guided to an introduction port 22 of the defibration unit 20. Consequently, the second sorted substance returns to the defibration unit 20 and is subjected to a defibrating process.

In addition, the first sorted substances sorted by the drum portion 41 are dispersed in the air through the meshes of the net of the drum portion 41 and drop toward a mesh belt 46 of the first web former 45 that is positioned below the drum portion 41.

The first web former 45 (separation unit) includes the mesh belt 46 (separation belt), a stretching roller 47, and a suction unit (suction mechanism) 48. The mesh belt 46 is an endless belt, is suspended on three stretching rollers 47, and is conveyed along with motion of the stretching rollers 47 in a direction represented by an arrow in the drawing. The mesh belt 46 has a surface configured of a net in which openings having a predetermined size are arranged. Among the first sorted substances dropping from the sorting unit 40, fine particles having a size to the extent that it is possible to pass through the mesh of the net fall downward from the mesh belt 46, and fibers having a size to the extent that it is not possible to pass through the mesh of the net are accumulated on the mesh belt 46 and are conveyed along with the mesh belt 46 in an arrow direction. The fine particles falling from the mesh belt 46 include a relatively small substance or a substance having low density (such as a resin grain, a coloring agent, or an additive) of the defibrated substances and are substances to be removed, which are not used in manufacturing of a sheet S by the sheet manufacturing apparatus 100.

The mesh belt 46 moves at a constant speed V1 at the time of a normal operation of manufacturing the sheet S. Here, the time of the normal operation means a time of an operation excluding times of execution of start control and stop control of the sheet manufacturing apparatus 100 to be described below and, to be more specific, indicates while the sheet manufacturing apparatus 100 manufactures the sheet S having a desired quality.

Hence, the defibrated substances subjected to the defibrating process by the defibration unit 20 are sorted into the first sorted substances and the second sorted substances by the sorting unit 40, and the second sorted substances return to the defibration unit 20. In addition, the first web former 45 removes the substance to be removed from the first sorted substances. The rest of the first sorted substances obtained by removing the substance to be removed are materials suitable for manufacturing the sheet S, and the materials are accumulated on the mesh belt 46 so as to form a first web W1.

The suction unit 48 suctions air from below the mesh belt 46. The suction unit 48 is connected to a dust collecting unit 27 (trapping unit) via a pipe 23. The dust collecting unit 27 is a filter-type or cyclone-type dust collecting device and separates fine particles from the air flow. A trapping blower 28 (suction unit) is installed downstream of the dust collecting unit 27, and the trapping blower 28 suctions air from the dust collecting unit 27. In addition, a part of the air discharged by the trapping blower 28 is sent to vaporization-type humidifiers 441, 442, and 443 (FIG. 3) to be described below, and the rest of the air is discharged out of the sheet manufacturing apparatus 100.

In this configuration, air from the suction unit 48 is suctioned by the trapping blower 28 through the dust collecting unit 27. In the suction unit 48, the fine particles that pass through the meshes of the net of the mesh belt 46 are suctioned along with the air and are set to the dust collecting unit 27 through the pipe 23. The dust collecting unit 27 separates the fine particles having passed through the mesh belt 46 from the air flow so as to accumulate the fine particles.

Hence, fibers obtained by removing the substances to be removed from the first sorted substance are accumulated on the mesh belt 46 such that the first web W1 is formed. The trapping blower 28 performs suction, thereby, promoting to form the first web W1 on the mesh belt 46, and the substances to be removed are rapidly removed.

The humidified air generated by the humidifying unit 204 is supplied to a space including the drum portion 41. The first sorted substance is humidified with the humidified air inside the sorting unit 40. Consequently, it is possible to weaken attachment of the first sorted substance to the mesh belt 46 due to an electrostatic force and peel the first sorted substance from the mesh belt 46 easily. Further, it is possible to suppress attachment of the first sorted substance to an inner wall of the rotary body 49 or the housing portion 43 due to the electrostatic force. In addition, the suction unit 48 is capable of suctioning the substance to be removed efficiently.

In the sheet manufacturing apparatus 100, a configuration of sorting and separating the first defibrated substance and the second defibrated substance from each other is not limited to the sorting unit 40 that includes the drum portion 41. For example, a configuration may be employed, in which the defibrated substances subjected to the defibrating process by the defibration unit 20 are classified by a classifier. For example, it is possible to use a cyclone classifier, an elbow jet classifier, or an eddy classifier as the classifier. When the classifiers are used, it is possible to sort and separate the first sorted substance and the second sorted substance from each other. Further, the classifier can realize a configuration of separating and removing the substance to be removed, which includes a relatively small substance or a substance having low density (such as a resin grain, a coloring agent, or an additive) of the defibrated substances. For example, in the configuration, the fine particles contained in the first sorted substance may be removed from the first sorted substance by the classifier. In this case, it is possible to employ a configuration in which the second sorted substance returns to the defibration unit 20, for example, the substances to be removed are collected by the dust collecting unit 27, and the first sorted substance is sent to a pipe 54 without the substances to be removed.

In a conveyance route of the mesh belt 46, the humidifying unit 210 supplies air containing mist to a downstream side of the sorting unit 40. The mist which is fine particles of water generated by the humidifying unit 210 drops toward the first web W1 and supplies moisture to the first web W1. Consequently, it is possible to adjust an amount of moisture contained in the first web W1, and thus it is possible to suppress attachment or the like of a fiber to the mesh belt 46 due to the static electricity.

The sheet manufacturing apparatus 100 includes the rotary body 49 that divides the first web W1 accumulated on the mesh belt 46. The first web W1 is peeled from the mesh belt 46 and is divided by the rotary body 49 at a position at which the mesh belt 46 is bent by the stretching roller 47.

The first web W1 is a soft material having a web shape, which is formed of the accumulated fibers, and the rotary body 49 loosens the fibers of the first web W1 so as to perform a process of proceeding to a state in which it is easy to mix a resin with the fibers by the mixer 50 to be described below.

The rotary body 49 has any configuration; however, in the embodiment, it is possible to have a rotating vane shape by having a plate-shaped vane that rotates. The rotary body 49 is disposed at a position at which the vane comes into contact with the first web W1 peeled from the mesh belt 46. The rotary body 49 rotates (for example, rotates in a direction represented by an arrow R in the drawing), and thereby the vane collides with the first web W1, which is peeled from the mesh belt 46 so as to be conveyed, such that the first web is divided, and a subdivided body P is generated.

It is preferable that the rotary body 49 be installed at a position at which the vane of the rotary body 49 does not collide with the mesh belt 46. For example, it is possible to have a gap of 0.05 mm or larger and 0.5 mm or smaller between a distal end of the vane of the rotary body 49 and the mesh belt 46. In this case, it is possible to divide the first web W1 efficiently without damage to the mesh belt 46 by the rotary body 49.

The subdivided body P divided by the rotary body 49 drops to an inside of a pipe 7 so as to be transported (conveyed) to the mixer 50 along with an air flow flowing in the inside of the pipe 7.

In addition, the humidified air generated by the humidifying unit 206 is supplied to a space including the rotary body 49. Consequently, it is possible to suppress a phenomenon in which the fibers are attached to the inside of the pipe 7 or the vane of the rotary body 49 due to static electricity. In addition, air having high humidity is supplied to the mixer 50 through the pipe 7, and thus it is possible to suppress an influence of the static electricity even in the mixer 50.

The mixer 50 communicates with a resin supply unit 52 that supplies a resin and the pipe 7 and includes the pipe 54, through which an air flow containing the subdivided body P flows, and a mixing blower 56 (transport blower). Hereinafter, a medium that is conveyed through the pipe 54 is referred to as the "raw material", optionally.

The subdivided body P is a fiber obtained by removing the substance to be removed from the first sorted substance having passed through the first sorting unit 40 as described above. The mixer 50 mixes the fiber configuring the subdivided body P and a resin (as described above, an additive including a resin).

In the mixer 50, the subdivided body P and the resin are conveyed while the mixing blower 56 generates an air flow, and the subdivided body and the resin are mixed in the pipe 54. In addition, the subdivided body P is loosened in a process of flowing inside the pipe 7 and the pipe 54 so as to have a finer fiber shape.

The resin supply unit 52 supplies a resin to the pipe 54 from the resin cartridge KT (FIG. 1) in which the resin is accumulated. The resin supply unit 52 will be described below in detail.

The resin supply unit 52 includes a discharge unit 52*a*. The discharge unit 52*a* is configured of an openable/closable shutter, for example. When the discharge unit 52*a* is closed, for example, a pipe channel, through which the discharge unit 52*a* is connected to the pipe 54, or an opening is blocked. In the configuration, in a state in which the discharge unit 52*a* is closed, supply of the resin from the resin supply unit 52 to the pipe 54 is stopped.

In a state in which the resin supply unit 52 does not operate, the resin is not supplied to the pipe 54 from the resin supply unit 52; however, in a case or the like where a pressure in the pipe 54 is a negative pressure, there is a possibility that the resin will flow to the pipe 54 even when the resin supply unit 52 is stopped. Such flowing of the resin is not caused in a state in which the discharge unit 52*a* is closed. Hence, the discharge unit 52*a* is closed, and thereby it is possible to reliably block the flowing of the resin.

The resin (additive including the resin stored in the resin cartridge XT) that is supplied by the resin supply unit 52 includes a resin for binding a plurality of fibers. The resin is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. The resins above may be used individually or in a proper combination thereof. In other words, the resin may contain a single substance, may be a mixture, or may contain a plurality of types of particles that are each configured of a single or a plurality of substances. In addition, the resin may be have a fiber shape or a powder shape.

The resin is melted by being heated so as to cause a plurality of fibers to be bounded to each other. Hence, in a state in which the resin is mixed with the fibers, and the resin is not heated to a temperature at which the resin is melted, the fibers are not bound to each other.

In addition, a resin that is supplied by the resin supply unit 52 may contain a colorant for coloring the fibers, a clumping inhibitor for inhibiting the fibers from clumping or the resin from clumping, or a flame retardant for retarding progression of burning of fibers or the like, in addition to the resin that causes the fibers to be bound. In addition, a resin that does not contain the colorant may be colorless or have a light color to the extent that the resin looks colorless or may be white.

The subdivided body P dropping through the pipe 7 and the resin that is supplied by the resin supply unit 52 are auctioned to the inside of the pipe 54 due to the air flow generated by the mixing blower 56 and pass through the inside of the mixing blower 56. An action of the air flow generated by the mixing blower 56 and/or a rotary unit such as the vane included in the mixing blower 56 causes the resin and the fiber configured of the subdivided body P to be mixed, and a mixture (mixture of the first sorted substance and the resin) is transported to the accumulation unit 60 through the pipe 54.

A mechanism that mixes the first sorted substance and the resin is not particularly limited, and a mechanism that performs agitation by a vane which rotates at a high speed may be employed, or a mechanism of using rotation of a container such as a V-shaped mixer may be employed, and the mechanism may be installed in front or rear of the mixing blower 56.

The accumulation unit 60 introduces the mixture having passed through the mixer 50 from an introduction port 62 and loosens intertwined defibrated substances (fibers) so as to be dropped while the fibers are dispersed in the air. Further, in a case where the resin that is supplied from the resin supply unit 52 has a fiber shape, the accumulation unit 60 loosens the intertwined resins. Consequently, the accumulation unit 60 is capable of accumulating the mixture in the second web former 70 with good uniformity.

In the embodiment, the accumulation unit 60 has a drum portion 61 (drum) and a housing portion (cover portion) 63 that accommodates the drum portion 61. The drum portion 61 is a cylinder sieve that is rotatably driven by a motor. The drum portion 61 has a net (a filter or a screen) and functions as a sieve. The drum portion 61 allows fibers or particles that are smaller than a mesh opening (opening) of the net through the mesh of the net and to be dropped from the drum portion 61. For example, a configuration of the drum portion 61 is the same as the configuration of the drum portion 41.

The "sieve" of the drum portion 61 may not have a function of sorting a specific target object. In other words, the "sieve" used as the drum portion 61 means a member having a net, and the drum portion 61 may allow the entire mixture introduced to the drum portion 61 to be dropped.

The second web former 70 is disposed below the drum portion 61. The second web former 70 (web former) accumulates passing substances having passed through the accumulation unit 60, and a second web 2 (accumulated object) is formed. For example, the second web former 70 includes a mesh belt 72 (belt), a stretching roller 74, and a suction mechanism 76.

The mesh belt 72 is an endless belt, is suspended on a plurality of stretching rollers 74, and is conveyed along with motion of the stretching rollers 74 in a direction represented by an arrow in the drawing. For example, the mesh belt 72 is made of metal, resin, fabric, or nonwoven fabric. The mesh belt 72 has a surface configured of a net in which openings having a predetermined size are arranged. Among the first fibers or particles dropping from the drum portion 61, fine particles having a size to the extent that it is possible to pass through the mesh of the net fall downward from the mesh belt 72, and fibers having a size to the extent that it is not possible to pass through the mesh of the net are accumulated on the mesh belt 72 and are conveyed along with the mesh belt 72 in an arrow direction. In addition, a controller 150 (FIG. 4) to be described below is capable of controlling a movement speed of the mesh belt 72. The mesh belt 72 moves at a constant speed V2 at the time of a normal operation of manufacturing the sheet S. The time of the normal operation has a meaning as described above.

The mesh belt 72 has minute meshes of the net, and the mesh can have a size so as not to allow most of the fibers or particles dropping from the drum portion 61 to pass through the mesh belt.

The suction mechanism 76 is provided below the mesh belt 72 (on a side opposite to a side of the accumulation unit 60). The suction mechanism 76 includes a suction blower 77, and thus it is possible to generate an air flow (air flow toward the mesh belt 72 from the accumulation unit 60) toward below the suction mechanism 76 with a suction force of the suction blower 77.

The suction mechanism 76 suctions mixtures dispersed in the air by the accumulation unit 60 to the mesh belt 72. Consequently, it is possible to promote forming of the second web w2 on the mesh belt 72 and to increase a discharge speed from the accumulation unit 60. Further, the suction mechanism 76 is capable of forming a down flow in a falling route of the mixture and preventing the defibrated substances and the resin from being intertwined during falling.

The suction blower 77 (accumulating suction unit) may discharge air suctioned from the suction mechanism 76 to the outside of the sheet manufacturing apparatus 100 through a trapping filter not shown. Alternatively, the air suctioned by the suction blower 77 may be sent into the dust collecting unit 27, and the substance to be removed, which is contained in the air auctioned by the suction mechanism 76, may be trapped.

The humidified air generated by the humidifying unit 208 is supplied to a space including the drum portion 61. It is possible to humidify an inside of the accumulation unit 60 with the humidified air, and thus it is possible to suppress the fibers or the particles from being attached to the housing portion 63 due to the electrostatic force, to drop the fibers and the particles rapidly to the mesh belt 72, and to form the second web W2 into a preferable shape.

As described above, through the accumulation unit 60 and the second web former 70 (a web forming step), the second web W2 is formed in a state of containing a large amount of air and being soft and expanded. The second web 12 accumulated on the mesh belt 72 is conveyed to the sheet former 80.

In a conveyance route of the mesh belt 72, the humidifying unit 212 supplies air containing mist to a downstream side of the accumulation unit 60. Consequently, the mist which is generated by the humidifying unit 212 is supplied to the second web W2, and an amount of moisture contained in the second web W2 is adjusted. Consequently, it is possible to suppress attachment or the like of a fiber to the mesh belt 72 due to the static electricity.

The sheet manufacturing apparatus 100 includes the conveying unit 79 that is provided to convey the second web t12 on the mesh belt 72 to the sheet former 80. For example, the conveying unit 79 includes a mesh belt 79*a*, a stretching roller 79*b*, and a suction mechanism 79*c*.

The suction mechanism 79*c* has an intermediate blower 79*d* (FIG. 3) and generates an upward air flow from the mesh belt 79*a* with a suction force of the intermediate blower 79*d*. The second web W2 is auctioned along with the air flow, and the second web W2 is separated from the mesh belt 72 so as to be attached to the mesh belt 79*a*. The mesh belt 79*a* moves along with rotation of the stretching roller 79*b* and conveys the second web W2 to the sheet former 80. For example, a movement speed of the mesh belt 72 is the same as a movement speed of the mesh belt 79*a*.

In this manner, the conveying unit 79 peels the second web W2 formed on the mesh belt 72 from the mesh belt 72 so as to transport the second web.

The sheet former 80 pressurizes and heats the second web W2 accumulated on the mesh belt 72 so as to form the sheet S. In the sheet former 80, fibers of a defibrated substance and a resin which are contained in the second web W2 are heated, and thereby a plurality of fibers in a mixture are bound to each other via the resin.

The sheet former 80 has a pressurizing unit 82 that pressurizes the second web W2 and a heating unit 84 that heats the second web W2 pressurized by the pressurizing unit 82.

The pressurizing unit 82 is configured of a pair of calendar rollers 85 (roller) and nips and pressurizes the second web W2 with a predetermined nip pressure. The second web W2 decreases in thickness by being pressurized, and density of the second web W2 increases. The pressurizing unit 82 has a pressurizing unit driving motor 337 (FIG. 3), and one of the pair of calendar rollers 85 is a drive roller that is driven by the pressurizing unit driving motor 337, and the other roller is a driven roller. The calendar roller 85 rotates by a drive force of the pressurizing unit driving motor 337 so as to convey the second web W2 having high density due to pressurization toward the heating unit 84.

Figure 3:
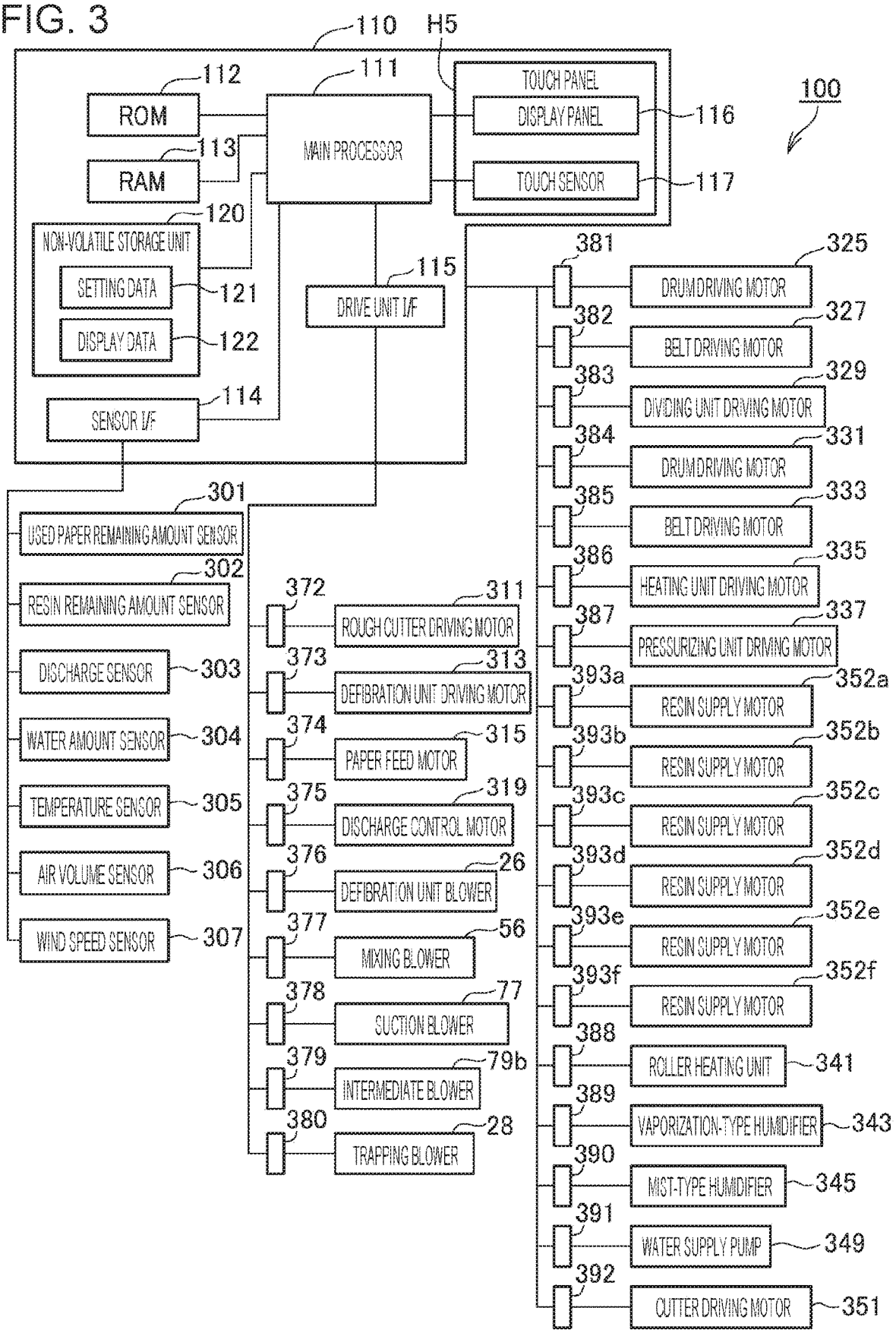
FIG. 3 is a diagram showing a functional configuration of the sheet manufacturing apparatus.

For example, the heating unit 84 can be configured to use a heating roller (heater roller), a thermal press forming device, a hot plate, a hot air blower, an infrared heater, or a flash fixing device. In the embodiment, the heating unit 84 has a pair of heating rollers 86. The heating rollers 86 are warmed to a preset temperature by a heater that is installed inside or outside. The heating rollers 86 nips the second web W2 pressurized by the calendar roller 85 so as to apply heat to the second web, and the sheet S is formed. The heating unit 84 has a heating unit driving motor 335 (FIG. 3). One of the pair of heating rollers 86 is a drive roller that is driven by the heating unit driving motor 335, and the other roller is a driven roller. The heating roller 86 rotates by a drive force of the heating unit driving motor 335 so as to convey the heated sheet S toward the cutter 90.

The number of the calendar rollers 85 included in the pressurizing unit 82 and the number of the heating rollers 86 included in the heating unit 84 are not particularly limited.

The cutter 90 (cutter unit) cuts the sheet S formed by the sheet former 80. In the embodiment, the cutter 90 includes a first cutter 92 that cuts the sheet S in a direction intersecting a conveyance direction of the sheet S and a second cutter 94 that cuts the sheet S in a direction parallel to the conveyance direction. For example, the second cutter 94 cuts the sheet S having passed through the first cutter 92.

As described above, a single sheet S having a predetermined size is formed. The cut single sheet S is discharged to a discharge unit 96. Through the discharge unit 96, the sheet S having the predetermined size is discharged to a discharge tray H12.

In the above-described configuration, the humidifying units 202, 204, 206, and 208 may be configured to be vaporization-type humidifiers. In this case, a configuration may be employed, in which humidified air generated by one humidifier diverges to be supplied to the rough crushing unit 12, the housing portion 43, the pipe 7, and the housing portion 63. In the configuration, a duct (not shown), through which the humidified air is supplied, is installed to diverge, and thereby it is possible to easily realize supply of the humidified air. In addition, it is needless to say that the humidifying units 202, 204, 206, and 208 can be each configured of two or three vaporization-type humidifiers. In the embodiment, as will be described below, the humidified air is supplied to the humidifying units 202, 204, 206, and 208 from a vaporization-type humidifier 343 (FIG. 3).

In addition, in the above-described configuration, the humidifying units 210 and 212 may be configured of one ultrasound type humidifier or may be configured of two ultrasound type humidifier. For example, it is possible to employ a configuration in which air containing mist generated by one humidifier diverges to be supplied to the humidifying unit 210 and the humidifying unit 212. In the embodiment, a mist-type humidifier 345 (FIG. 3) to be described below supplies the air containing the mist to the humidifying units 210 and 212.

In addition, the blowers included in the sheet manufacturing apparatus 100 described above are not limited to the defibration unit blower 26, the trapping blower 28, the mixing blower 56, the suction blower 77, and the intermediate blower 79*d*. For example, it is needless to say that an air blower that assists the blowers described above can be provided to the duct.

In addition, in the above-described configuration, the rough crushing unit 12 first roughly crushes the raw material, and the sheet S is manufactured from the roughly crushed raw material; however, it is also possible to employ a configuration in which the sheet S is manufactured by using the fibers as the raw material.

For example, a configuration may be employed, in which it is possible to feed, as the raw material, fibers equivalent to the defibrated substances subjected to the defibrating process by the defibration unit 20, to the drum portion 41. In addition, a configuration may be employed, in which it is possible to feed, as the raw material, fibers equivalent to the first sorted substances separated from the defibrated substances to the pipe 54. In this case, fibers obtained by processing used paper, pulp, or the like are supplied to the sheet manufacturing apparatus 100, and thereby it is possible to manufacture the sheet S.

FIG. 3 is a block diagram showing a configuration of a control system of the sheet manufacturing apparatus 100.

The sheet manufacturing apparatus 100 includes a control device 110 having a main processor 111 that controls every member of the sheet manufacturing apparatus 100.

The control device 110 has the main processor 111, a read only memory (RON) 112, and a random access memory (RAM) 113. The main processor 111 is an arithmetic processing unit such as a central processing unit (CPU) and executes a basic control program that is stored in the ROM 112, thereby controlling every member of the sheet manufacturing apparatus 100. The main processor 111 may be configured a system chip including a peripheral circuit such as the ROM 112 or the RAM 113 or another IP core.

The ROM 112 stores a program that is executed by the main processor 111, in a non-volatile manner. The RAM 113 forms a work area that is used by the main processor 111 so as to store a program that is executed by the main processor 111 or processing target data temporarily.

A non-volatile storage unit 120 stores a program that is executed by the main processor 111 or data that is processed by the main processor 111. For example, the non-volatile storage unit 120 stores setting data 121 and display data 122. The setting data 121 includes data for setting an operation of the sheet manufacturing apparatus 100. For example, the setting data 121 includes data of characteristics of various sensors included in the sheet manufacturing apparatus 100, a threshold value that is used in a process in which the main processor 111 detects abnormality based on a detection value detected by each of the various sensors, or the like. The display data 122 is data of a screen that is displayed by the main processor 111 on a display panel 116. The display data 122 may be fixed image data or may be data for setting a screen display of displaying data that is generated or acquired by the main processor 111.

The touch panel H5 has the display panel 116 and a touch sensor 117.

The touch panel H5 is a displaying panel such as a liquid crystal display, and thus the display panel 116 is installed on a front surface of the sheet manufacturing apparatus 100, for example. On the display panel 116, an operation state, various setting values, a warning display, or the like of the sheet manufacturing apparatus 100 is displayed in accordance with control by the main processor 111.

The touch sensor 117 detects a touch (contact) operation or a pressing operation. For example, the touch sensor 117 is configured of a pressure sensing sensor or a capacitive sensor which has a transparent electrode and is disposed to overlap a display surface of the display panel 116. In a case where the touch sensor 117 detects an operation, the touch sensor outputs operation data including an operation position or the number of operation positions to the main processor 111. The main processor 111 detects an operation on the display panel 116 in response to the output from the touch sensor 117 and acquires the operation position. The main processor 111 realizes a graphical user interface (GUI) operation based on the operation position detected by the touch sensor 117 and the display data 122 being displayed on the display panel 116.

The control device 110 is connected to sensors installed on every member of the sheet manufacturing apparatus 100 via a sensor interface (I/F) 114. The sensor I/F 114 is an interface that acquires a detection value that is output from a sensor and inputs the value to the main processor 111. The sensor I/F 114 may include an analogue/digital (A/D) converter that converts an analogue signal output from a sensor into digital data. In addition, the sensor I/F 114 may supply a drive current to every sensor. In addition, the sensor I/F 114 may have a circuit that acquires an output value from each of the sensors in association with a sampling frequency that is designated by the main processor 111 and outputs the value to the main processor 111.

The sensor I/F 114 is connected with a used paper remaining amount sensor 301, a resin remaining amount sensor 302, a discharge sensor 303, a water amount sensor 304, a temperature sensor 305, an air volume sensor 306, and a wind speed sensor 307.

The control device 110 is connected to every drive unit included in the sheet manufacturing apparatus 100 via a drive unit interface (I/F) 115. The drive unit included in the sheet manufacturing apparatus 100 is a motor, a pump, a heater, or the like. As shown in FIG. 3, the drive unit I/F 115 is connected every drive unit via drive integrated circuits (ICs) 372 to 393. The drive ICs 372 to 393 are circuits through which the drive current is supplied to a drive unit in accordance with the control by the main processor 111 and is configured of a semiconductor element for electric power or the like. For example, the drive ICs 372 to 393 are inverter circuits or drive circuits for driving a stepping motor. A specific configuration or specification of each of the drive ICs 372 to 393 is selected properly depending on a drive unit to be connected.

Figure 4:
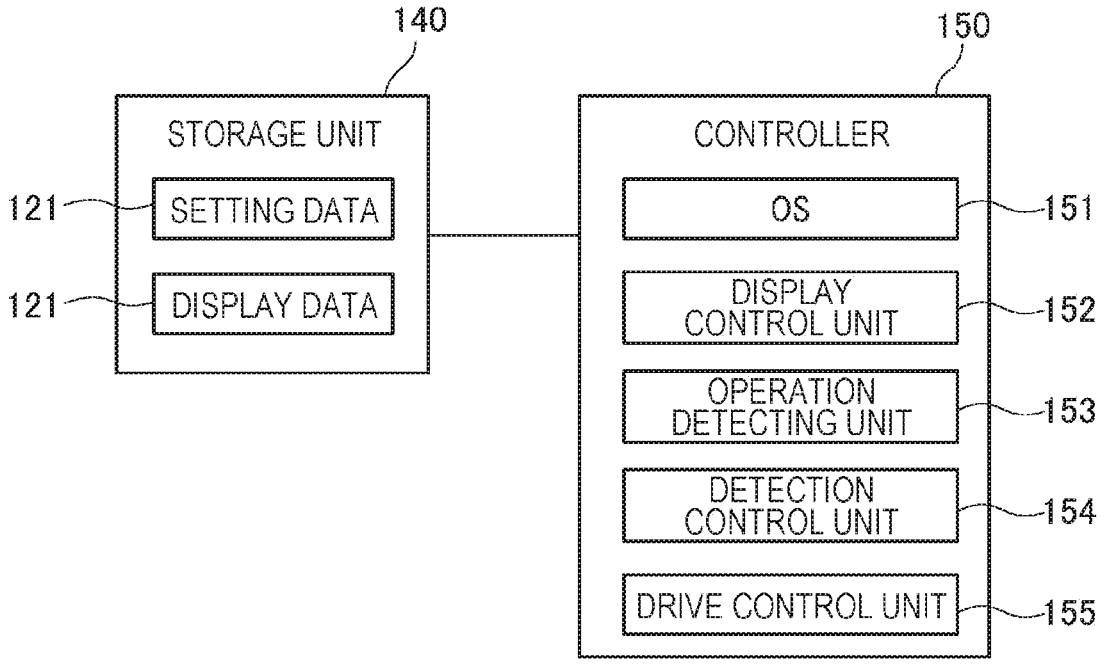
FIG. 4 is a diagram showing a functional configuration of main parts of the sheet manufacturing apparatus.

FIG. 4 is a functional block diagram of the sheet manufacturing apparatus 100 and shows functional configurations of the storage unit 140 and the controller 150. The storage unit 140 is a logical storage unit that is configured by the non-volatile storage unit 120 (FIG. 3) and may include the RON 112.

The main processor 111 executes a program, and thereby the controller 150 and various functional units included in the controller 150 are formed in cooperation with software and hardware. Examples of the hardware that configures the functional units include the main processor 111, the RON 112, the RAN 113, or the non-volatile storage unit 120.

The controller 150 has a function of an operating system (OS) 151, a display control unit 152, an operation detecting unit 153, a detection control unit 154, or a drive control unit 155.

The function of the operating system 151 is a function of a control program that is stored in the storage unit 140, and functions of the units of the controller 150 other than the operating system are functions of application programs which are executed on the operating system 151.

The display control unit 152 displays an image on the display panel 116 based on the display data 122.

In a case where an operation is detected by the touch sensor 117, the operation detecting unit 153 determines content of a GUI operation corresponding to a detected operation position.

The detection control unit 154 acquires detection values from the various sensors which are connected to the sensor I/F 114. In addition, the detection control unit 154 performs determination by comparing a detection value from the sensor connected to the sensor I/F 114 with a preset threshold value (setting value). In a case where a determination result indicates a condition in which notification is performed, the detection control unit 154 outputs notification content to the display control unit 152 such that the display control unit 152 performs notification by an image or text.

The drive control unit 155 controls a start and a stop of each of the drive units that are connected via the drive unit I/F 115. In addition, the drive control unit 155 may be configured to control a rotation speed of the defibration unit blower 26 or the mixing blower 56.

By coming back to FIG. 3, a rough crushing unit driving motor 311 is connected to the drive unit I/F 115 via the drive IC 372. The rough crushing unit driving motor 311 rotates a cutting blade (not shown) that cuts the used paper as the raw material.

A defibration unit driving motor 313 is connected to the drive unit I/F 115 via the drive IC 373. The defibration unit driving motor 313 rotates a rotor (not shown) included in the defibration unit 20.

The paper feed motor 315 is connected to the drive unit I/F 115 via the drive IC 374. The paper feed motor 315 is attached to the supply unit 10 and drives a roller (not shown) that conveys the used paper. When the controller 150 controls to supply a drive current to the paper feed motor 315 from the drive IC 374, and the paper feed motor 315 operates, the used paper that is accumulated as the raw material in the supply unit 10 is delivered to the rough crushing unit 12.

A discharge control motor 319 is connected to the drive unit I/F 115 via the drive IC 375. The discharge control motor 319 is connected to the discharge unit 52*a* and opens and closes the discharge unit 52*a*.

In addition, the defibration unit blower 26 is connected to the drive unit I/F 115 via the drive IC 376. Similarly, the mixing blower 56 is connected to the drive unit I/F 115 via the drive IC 377. In addition, the suction blower 77 is connected to the drive unit I/F 115 via the drive IC 378, and the intermediate blower 79*d* is connected to the drive unit I/F 115 via the drive IC 379. In addition, the trapping blower 28 is connected to the drive unit I/F 115 via the drive IC 380. According to the configuration, the control device 110 is capable of controlling the starts and stops of the defibration unit blower 26, the mixing blower 56, the suction blower 77, the intermediate blower 79*d*, and the trapping blower 28. In addition, the control device 110 may be configured to be capable of controlling the rotation speeds of the blowers. In this case, the control device may use an inverter as the drive ICs 376 to 380, for example.

A drum driving motor 325 is a motor that rotates the drum portion 41 and is connected to the drive unit I/F 115 via the drive IC 381.

A belt driving motor 327 is a motor that drives the mesh belt 46 and is connected to the drive unit I/F 115 via the drive IC 382.

A dividing unit driving motor 329 is a motor that rotates the rotary body 49 and is connected to the drive unit I/F 115 via the drive IC 383.

A drum driving motor 331 is a motor that rotates the drum portion 61 and is connected to the drive unit I/F 115 via the drive IC 384.

A belt driving motor 333 is a motor that drives the mesh belt 72 and is connected to the drive unit I/F 115 via the drive IC 385.

A heating unit driving motor 335 is a motor that drives the heating roller 86 of the heating unit 84 and is connected to the drive unit I/F 115 via the drive IC 386.

A pressurizing unit driving motor 337 is a motor that drives the calendar roller 85 of the pressurizing unit 82 and is connected to the drive unit I/F 115 via the drive IC 387.

A roller heating unit 341 is a heater that heats the heating roller 86. This heater may be installed inside the heating roller 86 or may apply heat from the outside of the heating roller 86. The roller heating unit 341 is connected to the drive unit I/F 115 via the drive IC 388.

The vaporization-type humidifier 343 includes a tank (not shown) that stores water and a filter (not shown) into which the water of the tank infiltrates and is a device that blows the filter so as to perform humidification. The vaporization-type humidifier 343 is connected to the drive unit I/F 115 via the drive IC 389 and turns ON/OFF the blowing to the filter in accordance with the control by the controller 150. In the embodiment, the humidified air is supplied to the humidifying units 202, 204, 206, and 208 from the vaporization-type humidifier 343. Hence, the humidifying units 202, 204, 206, and 208 supply the humidified air, which is supplied by the vaporization-type humidifier 343, to the rough crushing unit 12, the sorting unit 40, the pipe 54, and the accumulation unit 60. The vaporization-type humidifier 343 may be configured of a plurality of vaporization-type humidifiers. In this case, an installation place of each of the vaporization-type humidifiers may be any one of the rough crushing unit 12, the sorting unit 40, the pipe 54, and the accumulation unit 60.

The mist-type humidifier 345 includes a tank (not shown) that stores water and a vibrating unit that applies vibration to the water in the tank so as to generate misty water droplets. The mist-type humidifier 345 is connected to the drive unit I/F 115 via the drive IC 390 and turns ON/OFF the vibrating unit in accordance with the control by the controller 150. In the embodiment, air containing mist is supplied to the humidifying units 210 and 212 from the mist-type humidifier 345. Hence, the humidifying units 210 and 212 supply the air containing mist, which is supplied by the mist-type humidifier 345, to each of the first web W1 and the second web W2.

A water supply pump 349 is a pump that suctions water from the outside of the sheet manufacturing apparatus 100 and delivers the water into a tank (not shown) provided inside the sheet manufacturing apparatus 100. For example, when the sheet manufacturing apparatus 100 is started, an operator who operates the sheet manufacturing apparatus 100 set by delivering water to a water supplying tank. The sheet manufacturing apparatus 100 causes the water supply pump 349 to be operated and delivers water into the tank inside the sheet manufacturing apparatus 100 from the water supplying tank. In addition, the water supply pump 349 may supply water to the vaporization-type humidifier 343 and the mist-type humidifier 345 from the tank of the sheet manufacturing apparatus 100.

A cutter driving motor 351 is a motor that drives the first cutter 92 and the second cutter 94 of the cutter 90. The cutter driving motor 351 is connected to the drive unit I/F 115 via the drive IC 392.

Resin supply motors 352*a* to 352*f* are connected to the drive unit I/F 115 via drive ICs 393*a* to 393*f*.

The resin supply motors 352*a* to 352*f* will be described below in detail.

The used paper remaining amount sensor 301 is a sensor that detects a remaining amount of the used paper that is supplied as the raw material to the rough crushing unit 12. The used paper remaining amount sensor 301 detects a remaining amount of the used paper that is accommodated in the supply unit 10 (FIG. 2). For example, the controller 150 performs notification of lack of the used paper, in a case where the remaining amount of the used paper, which is detected by the used paper remaining amount sensor 301, is smaller than a setting value.

The resin remaining amount sensor 302 is a sensor that detects a remaining amount of resin that can be supplied from the resin supply unit 52. The resin remaining amount sensor 302 detects the remaining amount of the resin inside the resin cartridge KT that is connected to the resin supply unit 52. For example, the controller 150 performs notification, in a case where the remaining amount of the resin, which is detected by the resin remaining amount sensor 302, is smaller than a setting value.

The discharge sensor 303 detects the number of the sheets S accumulated in the discharge tray H12 included in the discharge unit 96. The controller 150 performs notification, in a case where the number of the sheets S, which is detected by the discharge sensor 303, is larger than a setting value.

The water amount sensor 304 is a sensor that detects an amount of water in a tank (not shown) installed in the sheet manufacturing apparatus 100. The controller 150 performs notification, in a case where the amount of water, which is detected by the water amount sensor 304, is smaller than a setting value. In addition, the water amount sensor 304 may be configured to be capable of also detecting a remaining amount of water in a tank of the vaporization-type humidifier 343 and/or the mist-type humidifier 345.

The temperature sensor 305 detects a temperature of air that flows inside the sheet manufacturing apparatus 100. In addition, the air volume sensor 306 detects an air volume of the air that flows inside the sheet manufacturing apparatus 100. In addition, the wind speed sensor 307 detects a wind speed of the air that flows inside the sheet manufacturing apparatus 100. For example, the temperature sensor 305, the air volume sensor 306, and the wind speed sensor 307 are disposed in a pipe 29, through which the air discharged by the trapping blower 28 flows, and detect the temperature, the air volume, and the wind speed. The controller 150 determines a state of an air blower inside the sheet manufacturing apparatus 100 based on detection values from the temperature sensor 305, the air volume sensor 306, and the wind speed sensor 307. The controller 150 controls the defibration unit blower 26 and the mixing blower 56 based on a determination result such that a state of the air blower inside the sheet manufacturing apparatus 100 is appropriately maintained.

Next, the resin supply unit 52 will be described below in detail.

Figure 5:
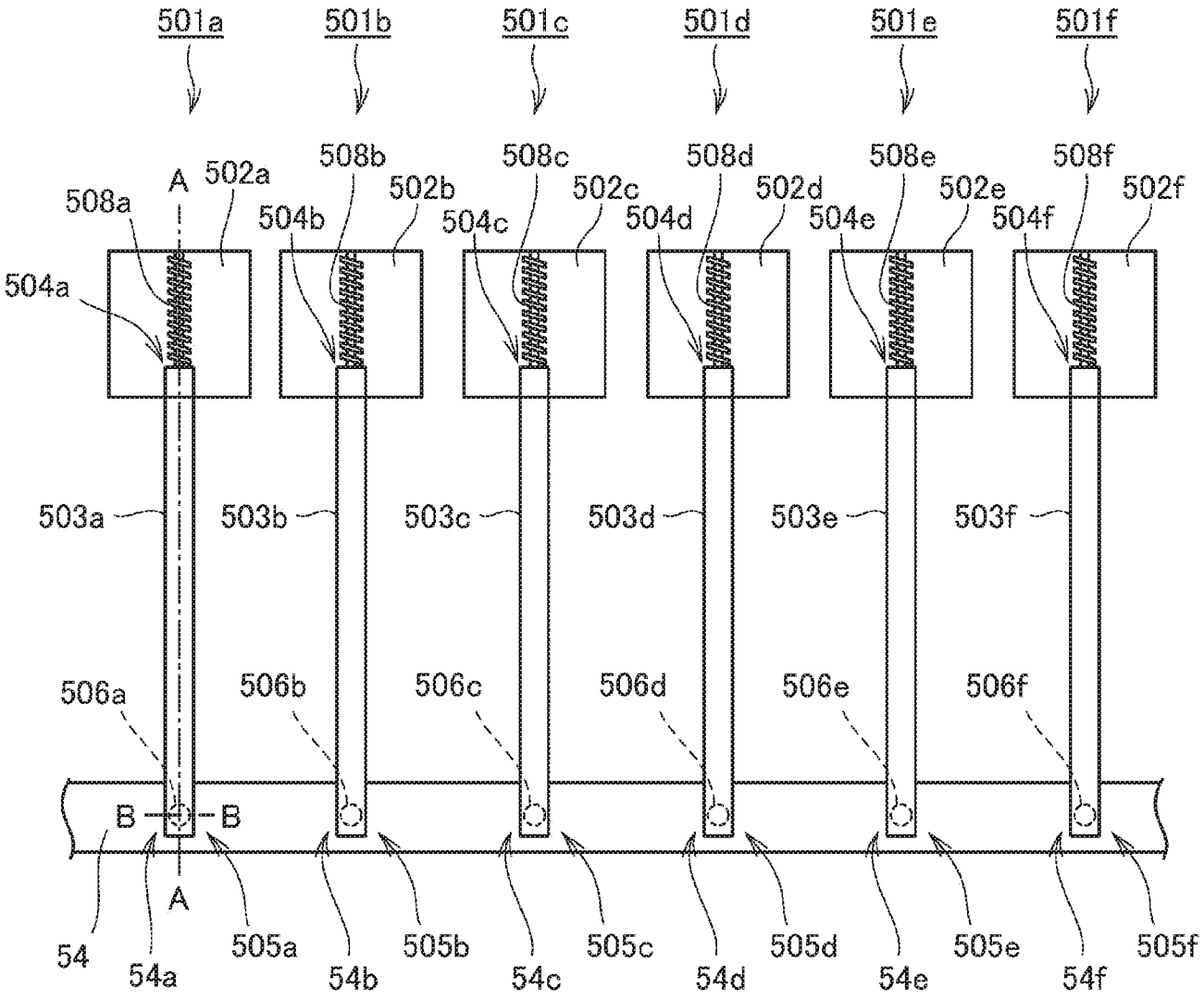
FIG. 5 is a view showing a configuration of a resin supply unit.
Figure 6:
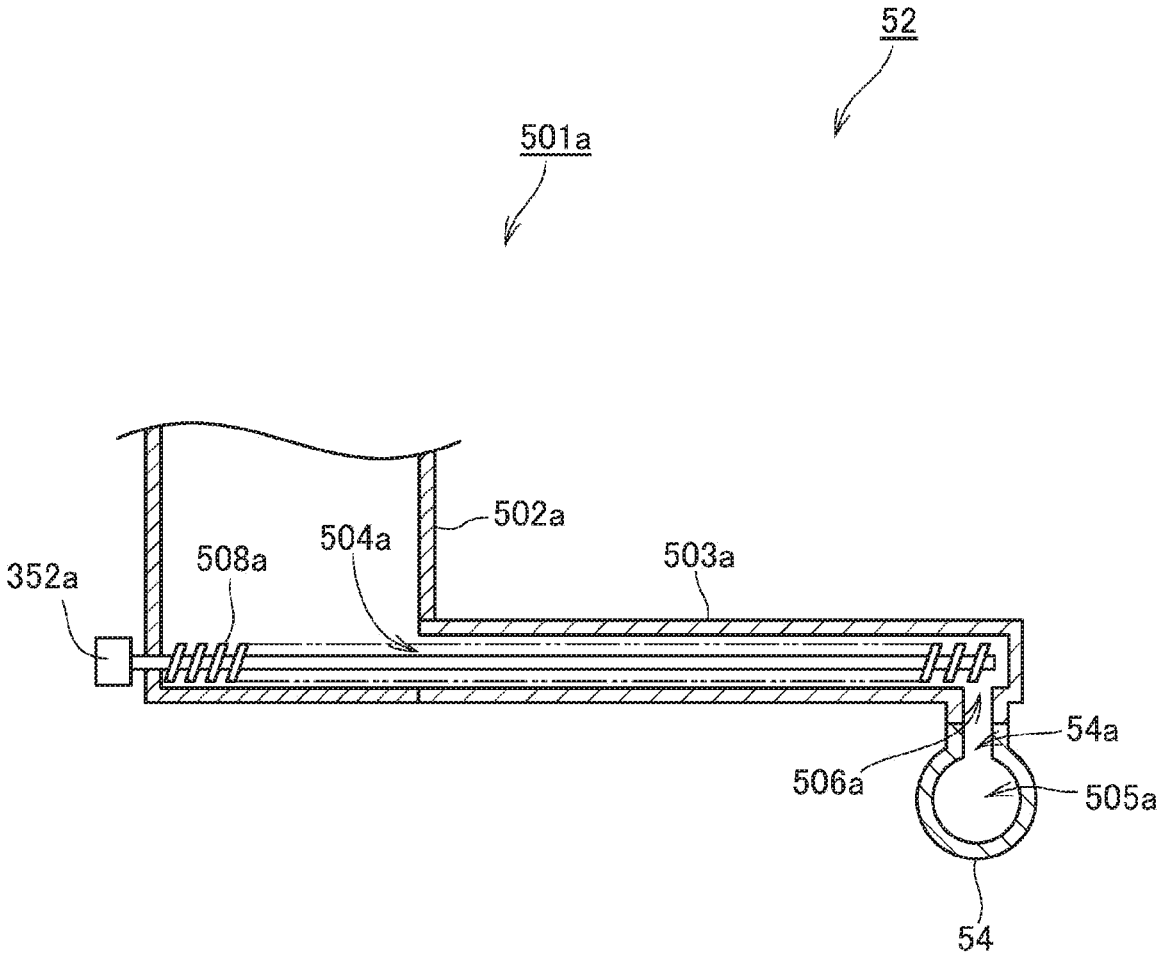
FIG. 6 is a sectional view taken along line A-A in FIG. 5.
Figure 7:
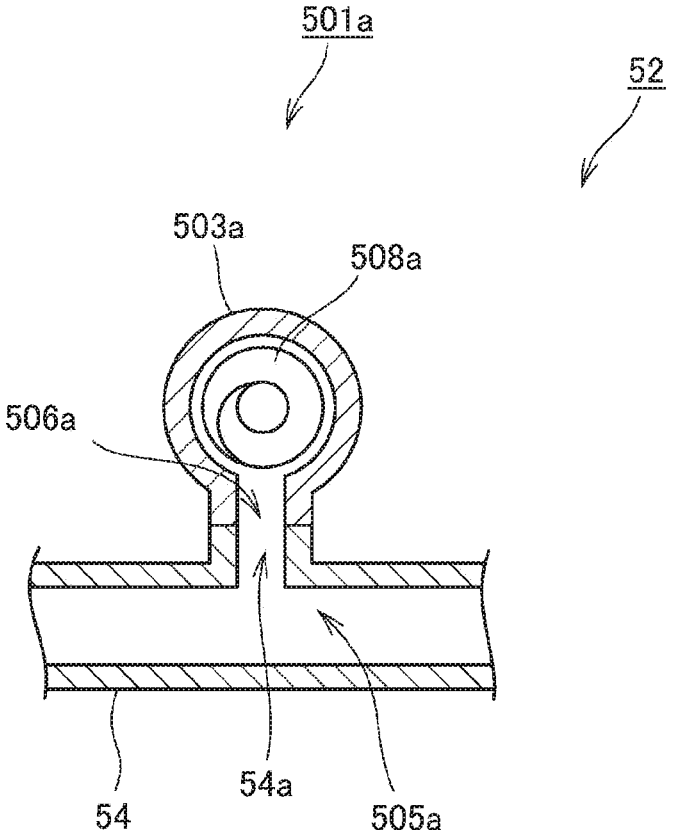
FIG. 7 is a sectional view taken along line B-B in FIG. 5.

In FIGS. 5 to 7, since members or the like are shown to have a size to the extent that it is possible to visually recognize the members or the like, scales of the members or the like are different from real scales thereof.

In addition, in FIGS. 5 to 7, for convenience of description, a configuration according to the discharge unit 52*a* is omitted.

FIG. 5 is a schematic plan view showing a configuration of the resin supply unit 52. FIG. 6 is a sectional view taken along line A-A in FIG. 5. FIG. 7 is a sectional view taken along line B-B in FIG. 5.

As shown in FIG. 5, the resin supply unit 52 has six resin supply units 501*a* to 501*f* corresponding to the six resin cartridges KTa to KTf. In other words, the resin supply unit 501*a* corresponds to the resin cartridge KTa, the resin supply unit 501*b* corresponds to the resin cartridge KTb, the resin supply unit 501*c* corresponds to the resin cartridge KTc, the resin supply unit 501*d* corresponds to the resin cartridge KTd, the resin supply unit 501*e* corresponds to the resin cartridge KTe, and the resin supply unit 501*f* corresponds to the resin cartridge KTf.

As shown in FIGS. 5 and 6, the resin supply unit 501*a* corresponding to the resin cartridge KTa includes a resin container 502*a*. The resin container 502*a* is a container that stores a resin (in this case, the first uncolored resin) from the resin cartridge KTa. In the embodiment, the resin cartridge KTa is mounted on the resin container 502*a*, and the resin contained in the resin cartridge KTa is supplied to the resin container 502*a* due to the gravity via a predetermined route. Any method of supplying the resin to the resin container 502*a* from the resin cartridge KTa may be employed.

As shown in FIGS. 5 to 7, the resin supply unit 501*a* has a resin supply channel 503*a* through which the resin contained in the resin container 502*a* is supplied to the pipe 54. The resin supply channel 503*a* is provided between the resin container 502*a* and the pipe 54.

The resin supply channel 503*a* is a pipe-shaped member extending to have a straight line shape and extends between the resin container 502*a* and the pipe 54.

The resin supply channel 503*a* is provided with a communication port 504*a* that communicates with the resin container 502*a* and a supply port 506*a* that communicates with the pipe 54 at a convergence portion 505*a*. In the embodiment, the communication port 504*a* is disposed in a bottom portion of the resin container 502*a*. In addition, the supply port 506*a* is disposed at a position corresponding to an introduction port 54*a* provided above the convergence portion 505*a* of the pipe 54. The supply port 506*a* and the introduction port 54*a* may be sealed and joined to each other such that the resin is not scattered.

In the resin supply channel 503*a*, a screw feeder 508*a* for conveying the resin contained in the resin container 502*a* to the pipe 54 is provided. The screw feeder 508*a* is connected to the resin supply motor 352*a* via a power transmitting mechanism (not shown). The screw feeder 508*a* rotates along with driving of the resin supply motor 352*a* and conveys the resin contained in the resin container 502*a* to the convergence portion 505*a* of the pipe 54 along with the rotation thereof.

As shown in FIGS. 5 to 7, the resin supply units 501*b* to 501*f* have the same configuration as that of the resin supply unit 501*a*. In other words, the resin supply units 501*b* to 501*f* include resin containers 502*b* to 502*f* and resin supply channels 503*b* to 503*f*, respectively. The resin supply channels 503*b* to 503*f* are provided with communication ports 504*b* to 504*f* and supply ports 506*b* to 506*f*, respectively. The supply ports 506*b* to 506*f* communicates with introduction ports 54*b* to 54*f* of the pipe 54 at convergence portions 505*b* to 505*f* in the pipe 54, respectively. The screw feeders 508*b* to 508*f* are provided in the resin supply channels 503*b* to 503*f*, respectively, and the screw feeders 508*b* to 508*f* are connected to the resin supply motors 352*b* to 352*f* via a power transmitting mechanism (not shown), respectively. The screw feeders 508*b* to 508*f* rotate along with driving of the resin supply motors 352*b* to 352*f*, respectively, and conveys the resin contained in the resin containers 502*b* to 502*f* to the convergence portions 505*b* to 505*f* of the pipe 54 along with the rotation thereof, respectively.

In this manner, in the embodiment, the resin supply units 501*a* to 501*f* are provided for each of the resin cartridges KT, and the screw feeders 508*a* to 508*f* supply the resin from the resin containers 502*a* to 502*f* to the raw material of the pipe 54.

Figure 8:
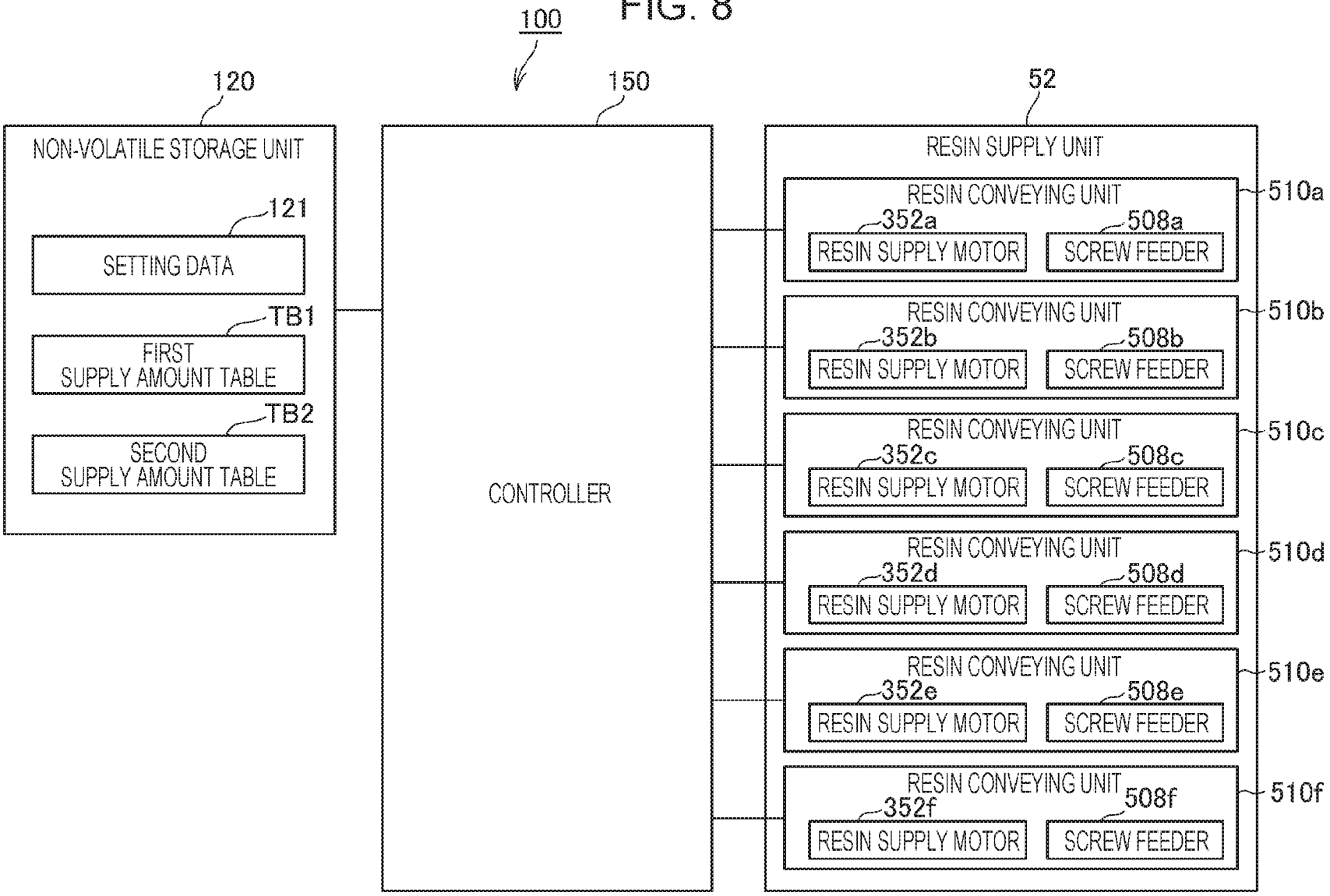
FIG. 8 is a diagram showing a functional configuration of main parts of the sheet manufacturing apparatus.

FIG. 8 is a diagram schematically showing an example suitable for describing a functional configuration of main parts of the sheet manufacturing apparatus 100.

As described above, the controller 150 is a functional unit that executes a process in cooperation with software and hardware, such as execution of a program by the main processor 111.

The non-volatile storage unit 120 stores a first supply amount table TB1 and a second supply amount table TB2, in addition to the setting data 121 described above. The first supply amount table TB1 and the second supply amount table TB2 will be described below.

As shown in FIG. 8, the resin supply unit 52 includes resin conveying units 510*a* to 510*f*. The resin conveying units 510*a* to 510*f* include at least the resin supply motors 352*a* to 352*f* and the screw feeders 508*a* to 508*f* which are connected to the motors, respectively. The controller 150 controls to drive the resin supply motors 352*a* to 352*f* so as to rotate the screw feeders 508*a* to 508*f*, and the resin conveying units 510*a* to 510*f* convey the resin contained in the resin containers 502*a* to 502*f* into the resin supply channels 503*a* to 503*f* and supply the resin to the pipe 54.

Next, when the sheet manufacturing apparatus 100 manufactures the sheet, a process of supplying the resin by the resin supply unit 52 will be described.

In addition, at a predetermined timing before the sheet manufacturing apparatus 100 manufactures the sheet, a user conducts setting related to colors of the sheet that is manufactured by the sheet manufacturing apparatus 100.

In the embodiment, the sheet manufacturing apparatus 100 provides a user interface to be described below, and the user can conduct setting related to colors with ease and accuracy.

Hereinafter, first, regarding setting related to a color of the sheet by the user, the user interface that is displayed on the touch panel H5 and a process of the controller 150 will be described in parallel with work performed by the user.

In the following description, a touch operating button means an operation button by which it is possible to perform a touch operation, which is displayed in the user interface.

In addition, a time point is described as "00:00" or "13:05" in the 24-hour system.

In addition, a period from turning ON of the breaker switch H8 and a power switch H7 of the sheet manufacturing apparatus 100 to shutting down of the sheet manufacturing apparatus 100 is referred to as a "power-on period".

In addition, in the following description, even in a case where particular description is not provided, the controller 150 itself displays the user interface, displays an image, information, or another object on the user interface, and transits from one user interface to another user interface.

Figure 9:
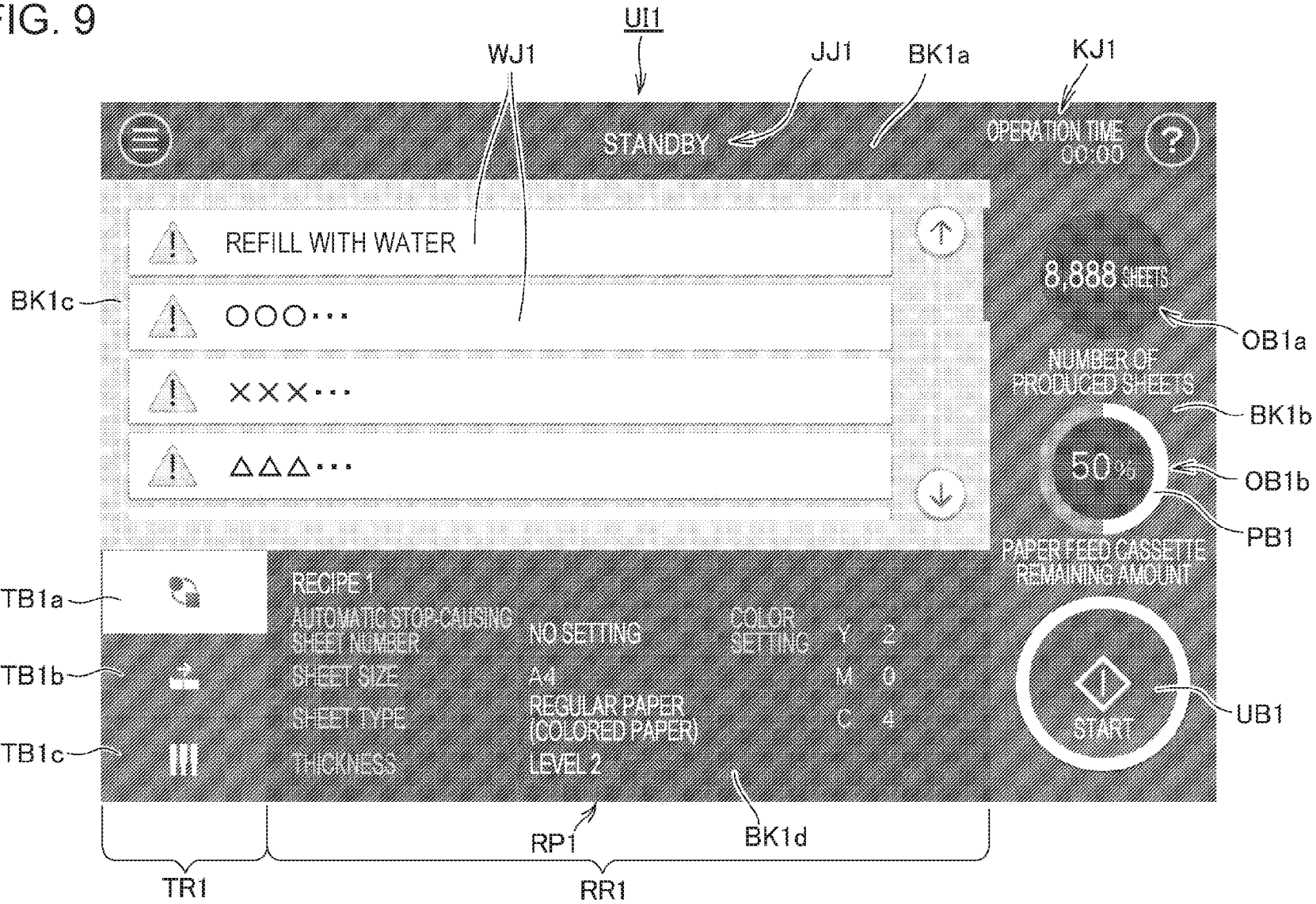
FIG. 9 is a view showing a first user interface.

FIG. 9 is a view showing a first user interface UI1.

In particular, FIG. 9 shows the first user interface UI1 that is displayed on the touch panel H5 in a case where the sheet manufacturing apparatus 100 does not execute a process of manufacturing a sheet.

The first user interface UI1 is appropriately displayed as a main user interface on the touch panel H5 in a power-on period.

As shown in FIG. 9, the first user interface UI1 is configured by four blocks depending on content of information to be displayed. Specifically, the first user interface UI1 is configured to have a strip-shaped first block BK1*a* that is formed on an upper end portion, a second block BK1*b* that is positioned in a left end portion and extends in a vertical direction, a third block BK1*c* that is positioned in an upper portion of a region on a left side of the second block BK1*b*, and a fourth block BK1*d* that is positioned below the third block BK1*c* in a region on the left side of the second block BK1*b*.

In the first block BK1*a*, a state information JJ1 (standby) indicating a state of the sheet manufacturing apparatus 100 and operation time information KJ1 indicating an operation time of the sheet manufacturing apparatus 100. The operation time information KJ1 is information indicating a total time, during which the sheet manufacturing apparatus 100 executes the process of manufacturing the sheet, in the power-on period to which a current time point belongs, after the latest turning ON of the breaker switch H8 and the power switch H7. Content of the operation time information KJ1 may be content other than the content according to the embodiment. For example, the operation time information KJ1 may be information indicating a length of elapsed time after the latest turning ON of the breaker switch H8 and the power switch H7. For example, the operation time information KJ1 may be information indicating a total time, during which the sheet manufacturing apparatus 100 executes the process of manufacturing the sheet, between a specific time point (for example, the latest time point of "00:00") to the current time point, regardless of ON and OFF of the power switch H7. For example, the operation time information KJ1 may be information indicating a total time, during which the sheet manufacturing apparatus 100 executes the process of manufacturing the sheet, in the previous power-on period of the power-on period to which the current time point belongs. For example, the operation time information may be information indicating a length of the previous power-on period of the power-on period to which the current time point belongs.

The second block BK1*b* is a block in which information including raw material information of the raw material that is supplied to the sheet manufacturing apparatus 100 and manufacturing information of the sheet that is manufactured by the sheet manufacturing apparatus 100 is displayed.

As shown in FIG. 9, a manufacturing information image OB1*a* that is a circular image is displayed in an upper portion of the second block BK1*b*. The manufacturing information image OB1*a* also functions as a touch operating button, and thus it is possible to switch information that is displayed in the corresponding image between first manufacturing information (to be described below) and second manufacturing information (to be described below) through a touch operation.

In the manufacturing information image OB1*a*, the following information is displayed as the first manufacturing information depending on a state of the sheet manufacturing apparatus 100. In other words, in a case where the sheet manufacturing apparatus 100 does not start manufacturing once after the power switch H7 is turned ON, in the manufacturing information image OB1*a*, as the first manufacturing information, information indicating a total number of sheets manufactured by the sheet manufacturing apparatus 100 in the previous power-on period of the power-on period to which the current time point belongs (information of the number of sheets manufactured in a predetermined period) is displayed. A user refers to the first manufacturing information displayed in the manufacturing information image OB1*a*, thereby, being able to recognize the number of sheets manufactured in the previous power-on period of the power-on period to which the current time point belongs. In addition, the user can use the first manufacturing information as a reference of the number of sheets that are to be manufactured in the power-on period to which the current time point belongs.

On the other hand, after the sheet manufacturing apparatus 100 starts manufacturing the sheet after the power switch H7 is turned ON, in the manufacturing information image OB1*a*, as the first manufacturing information, information indicating a total number of sheets manufactured to the current time point by the sheet manufacturing apparatus 100 in the power-on period to which the current time point belongs (information of the number of sheets manufactured after the start of the manufacturing of the sheets, based on the supplied raw material) is displayed. The user refers to the first manufacturing information displayed in the manufacturing information image OB1*a*, thereby, being able to easily recognize the number of sheets manufactured to the current time point and being able to use the second manufacturing information when determining whether or not to stop the manufacturing.

In addition, in the manufacturing information image OB1*a*, the following information is displayed as the second manufacturing information. In other words, in the manufacturing information image OB1*a*, information indicating a total number of sheets manufactured by the sheet manufacturing apparatus 100 (information of the number of sheets manufactured in a predetermined period) between a specific time point (for example, the latest time point of "00:00") to the current time point is displayed. The user refers to the second manufacturing information displayed in the manufacturing information image OB1*a*, thereby, being able to easily recognize the total number of sheets manufactured by the sheet manufacturing apparatus 100 from the specific time point to the current time point. For example, in a case where the specific time point is the "latest time point of "00:00"", the user is able to recognize the total number of sheets manufactured by the sheet manufacturing apparatus 100 to the current time point in a "day" to which the current time point belongs.

As described above, the user is able to switch the information that is displayed in the manufacturing information image OB1*a* between the first manufacturing information and the second manufacturing information through simple work of a touch operation on the manufacturing information image OB1*a*.

As shown in FIG. 9, in the second block BK1*b*, a raw material information image OB1*b* that is a circular image is displayed below the manufacturing information image OB1*a*. The raw material information image OB1*b* also functions as a touch operating button, and thus it is possible to switch information that is displayed in the corresponding image between first raw material information (to be described below) and second raw material information (to be described below) through a touch operation.

FIG. 9 shows a first user interface UI1 in a state in which the first raw material information is displayed in the raw material information image OB1*b*.

As shown in FIG. 9, in the raw material information image OB1*b*, the following information is displayed as the first raw material information. In other words, in the raw material information image OB1*b*, information indicating a ratio of a remaining amount of used paper to the maximum amount of used paper that can be accommodated in the paper feed cassette 11 by percentage is displayed as the first raw material information. In addition, in a case of a state in which the first raw material information is displayed in the raw material information image OB1*b*, a progress bar PB1 indicating the corresponding ratio is displayed in the raw material information image OB1*b* along an outer circumference of the raw material information image OB1*b*. The user refers to the first raw material information displayed in the raw material information image OB1*b* and the progress bar PB1, thereby, being able to recognize the corresponding ratio intuitively with ease and accuracy.

In addition, in the raw material information image OB1*b*, the following information is displayed as the second raw material information. In other words, in the raw material information image OB1*b*, information indicating a total number of sheets of used paper supplied and consumed in the sheet manufacturing apparatus 100 (information of an amount of the raw material supplied and consumed in a predetermined period) between a specific time point (for example, the latest time point of "00:00") to the current time point is displayed. The user refers to the second raw material information displayed in the raw material information image OB1*b*, thereby, being able to easily and accurately recognize the total number of sheets of used paper supplied and consumed in the sheet manufacturing apparatus 100 from the specific time point to the current time point. For example, in a case where the specific time point is the "latest time point of "00:00"", the user is able to recognize the total number of sheets of used paper supplied and consumed in the sheet manufacturing apparatus 100 to the current time point in a "day" to which the current time point belongs.

As shown in FIG. 9, in the second block BK1*b*, an operation start button UB5 is displayed below the raw material information image OB1*b*. The operation start button UB5 is a touch operating button for instructing a start of the process of manufacturing the sheet. In a case of detecting that a touch operation is performed on the operation start button UB5, the controller 150 controls every member and starts manufacturing the sheet with the used paper as the raw material.

During the execution of the process of manufacturing the sheet by the sheet manufacturing apparatus 100, a touch operating button for instructing a stop of the corresponding process is displayed, instead of the operation start button UB5. In a case of detecting that the operation start button is operated, the controller 150 controls every member and stops the process of manufacturing the sheet.

In the first user interface UI1, a third block BK1*c* is a block in which items of warning information WJ1 (warning information) of warnings are listed.

The warning information WJ1 is information indicating a request to the user in order to execute the process of manufacturing the sheet normally, information indicating an error occurred in the sheet manufacturing apparatus 100, or the like.

As shown in FIG. 9, in the first user interface UI1, a fourth block BK1*d* is a block in which information including processing information of processing of the sheet is displayed.

As shown in FIG. 9, the fourth block BK1*d* has a tab displaying region TR1 formed in a left portion and a corresponding information displaying region RR1 formed in a right portion, as regions.

The tab displaying region TR1 is a region in which three alternatively selectable tabs TB1*a*, TB1*b*, and TB1*c* are displayed. The corresponding information displaying region RR1 is a region in which information corresponding to the tab selected in the tab displaying region TR1 is displayed.

FIG. 9 shows the first user interface UI1 in a state in which the tab TB1*a* is selected.

The tab TB1*a* is a tab for instructing a display of recipe related information RP1 about a selected recipe (to be described below), in the corresponding information displaying region RR1. Hence, in a case where the tab TB1*a* is selected, the recipe related information RP1 is displayed in the corresponding information displaying region RR1.

Hereinafter, the "recipe" will be described, and then the recipe related information RP1 will be described.

The recipe is setting related to the manufacturing of the sheet by the sheet manufacturing apparatus 100 and includes a plurality of setting items and setting values corresponding to the setting items. The sheet manufacturing apparatus 100 executes the process in accordance with the recipe in manufacturing of the sheet. To be clarified below, in the embodiment, the user is able to register ten recipes of a recipe 1 to a recipe 10 as the recipe in advance and is able to select one recipe that is used in the manufacturing of the sheet from the ten recipes.

In the embodiment, setting items of the recipe include an automatic stop-causing sheet number setting item, a sheet size setting item, a sheet type setting item, a sheet thickness setting item, and a color setting item.

The automatic stop-causing sheet number setting item is a setting item that is associated with an automatic stop-causing sheet number as a setting value. The automatic stop-causing sheet number is the number of sheets that are continuously manufactured after the sheet manufacturing apparatus 100 starts manufacturing the sheet. In a case where manufacturing of the sheets is completed by the automatic stop-causing sheet number of sheets after the manufacturing of the sheet is started, the controller 150 stops the process of manufacturing the sheet automatically.

The sheet size setting item is a setting item that is associated with a sheet size as a setting value. The sheet size is a size of the sheet that is manufactured by the sheet manufacturing apparatus 100. In the embodiment, the sheet size includes "A4" and "A3". A configuration may be employed, in which another size (for example, "B5") may be present as the sheet size.

The sheet type setting item is a setting item that is associated with a sheet type as a setting value. The sheet type is a type of sheet that is manufactured by the sheet manufacturing apparatus 100. In the embodiment, sheet types include "regular paper (white paper)", "regular paper (colored paper)", "cardboard (white paper)", and "cardboard (colored paper)".

Here, in the embodiment, regarding the sheet that is manufactured by the sheet manufacturing apparatus 100, the "regular paper" means paper having a predetermined thickness as a thickness of a sheet, which is smaller than a thickness of cardboard to be described below. The regular paper has higher flexibility than the cardboard. In addition, regarding the sheet that is manufactured by the sheet manufacturing apparatus 100, the "cardboard" means paper having a thickness of a sheet which is larger than that of the regular paper. As will be clarified below, the user is able to adjust the thickness of the sheet that is manufactured by the sheet manufacturing apparatus 100.

In addition, regarding the sheet that is manufactured by the sheet manufacturing apparatus 100, the "white paper" means paper having a color of a sheet which is white or a color equivalent to white. Hereinafter, regarding the color of the sheet to be manufactured, the white color and a color equivalent to the white color are simply referred to as the "white color". As will be clarified below, the user is able to adjust a degree of white of white paper that is manufactured by the sheet manufacturing apparatus 100.

In addition, regarding the sheet that is manufactured by the sheet manufacturing apparatus 100, the "colored paper" means paper having a color other than the white color, as the color of the sheet and means colored paper by using any colored resin of cyan, magenta, or yellow. As will be clarified below, the user is able to adjust the color of the colored paper that is manufactured by the sheet manufacturing apparatus 100.

Sheet type: The "regular paper (white paper)" is a type corresponding to a combination of the regular paper and the white paper, regarding the sheet that is manufactured by the sheet manufacturing apparatus 100.

Sheet type: The "regular paper (colored paper)" is a type corresponding to a combination of the regular paper and the colored paper, regarding the sheet that is manufactured by the sheet manufacturing apparatus 100.

Sheet type: The "cardboard (white paper)" is a type corresponding to a combination of the cardboard and the white paper, regarding the sheet that is manufactured by the sheet manufacturing apparatus 100.

Sheet type: The "cardboard (colored paper)" is a type corresponding to a combination of the cardboard and the colored paper, regarding the sheet that is manufactured by the sheet manufacturing apparatus 100.

The sheet thickness setting item is a setting item that is associated with a sheet thickness as a setting value. The sheet thickness is a level of a thickness of a sheet that is manufactured by the sheet manufacturing apparatus 100. In the embodiment, the sheet thickness is any value of a level of ten levels of level 1 to level 10. Regarding the levels, level 1 represents the smallest thickness, level 10 represents the largest thickness, and the thickness increases gradually from level 1 to level 10.

The color setting item is a setting item that is associated with a color setting value as a setting value.

The color setting value is a setting value of an amount of resin that is supplied to a predetermined amount of raw material during the manufacturing of the sheet, in a case where the sheet to be manufactured is the "colored paper", the amount of resin being represented by values from "0" to "4", regarding each color of yellow, magenta, and cyan. Hereinafter, values of "0" to "4" representing a supply amount of yellow resin are referred to as yellow values, values of "0" to "4" representing a supply amount of magenta resin are referred to as magenta values, and values of "0" to "4" representing a supply amount of cyan resin are referred to as cyan values.

In addition, the color setting value is a setting value of an amount of white resin that is supplied to a predetermined amount of raw material during the manufacturing of the sheet, in a case where the sheet to be manufactured is the "white paper", the amount of resin being represented by values from "0" to "4", regarding the white color. Hereinafter, values of "0" to "4" representing a supply amount of white resin are referred to as white values.

As shown in FIG. 9, in the corresponding information displaying region RR1 according to the tab TB1*a*, information indicating a setting value of a setting item of each of the recipes, which is selected at the current time point, is displayed.

In particular, in the corresponding information displaying region RR1, information in the following state is displayed regarding the color setting value.

In other words, the yellow value, the magenta value, and the cyan value are displayed as the color setting values in the corresponding information displaying region RR1 according to the tab TB1*a*, in a case where the sheet type is the "regular paper (colored paper)" or the "cardboard (colored paper)", and the sheet that is manufactured by the sheet manufacturing apparatus 100 is the "colored paper". FIG. 9 shows the first user interface UI1 in which the yellow value, the magenta value, and the cyan value are displayed.

On the other hand, the white value is displayed as the color setting value in the corresponding information displaying region RR1 according to the tab TB1*a*, in a case where the sheet type is the "regular paper (white paper)" or the "cardboard (white paper)", and the sheet that is manufactured by the sheet manufacturing apparatus 100 is the "white paper".

The user refers to the corresponding information displaying region RR1 according to the tab TB1*a*, thereby, being able to easily and accurately recognizing content of the selected recipe, specifically, item values of all of the setting items in the selected recipe.

Figure 10:
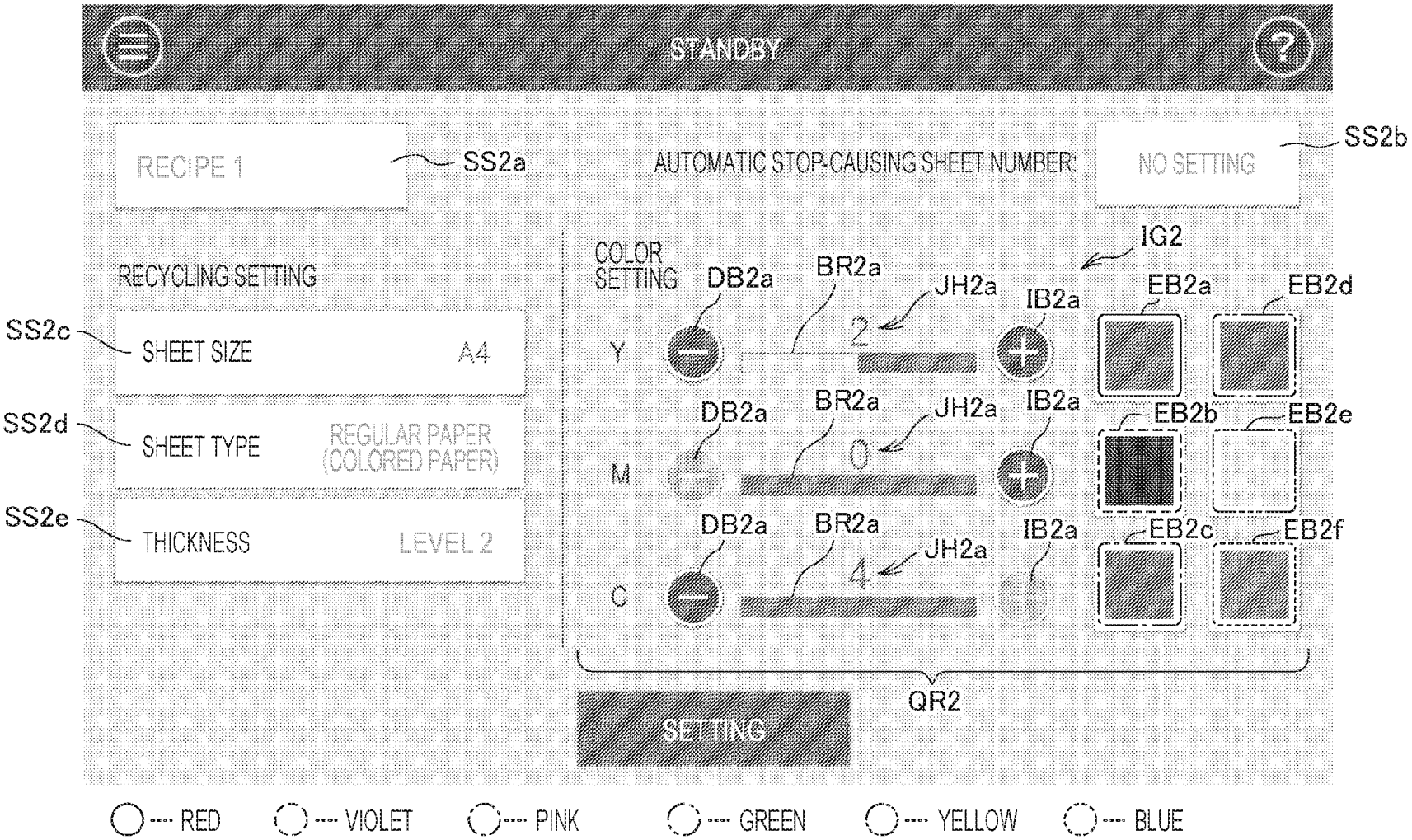
FIG. 10 is a view showing a second user interface.

FIG. 10 is a view showing a second user interface UI2 on which the user conducts setting related to a recipe (setting related to a color of the sheet to be manufactured). As will be clarified below, the user is able to conduct setting related to a color of the sheet to be manufactured by using the second user interface UI2.

In a case of conducting setting related to the recipe, a predetermined touch operation is performed on a predetermined user interface such that the second user interface UI2 is displayed on the touch panel H5.

As shown in FIG. 10, a recipe selecting button SS2*a* is provided on the second user interface UI2. The recipe selecting button SS2*a* is a touch operating button on which the touch operation is performed when the recipe is selected. In addition, in the recipe selecting button SS2*a*, information indicating a recipe (any one of the recipe 1 to the recipe 10) that is selected at the current time point is displayed. The user refers to the information displayed in the recipe selecting button SS2*a*, thereby, being able to recognize the recipe that is selected at the current time point. In addition, in a case where selection of the recipe is performed, the user conducts the touch operation on the recipe selecting button SS2*a*. When the controller 150 detects that the touch operation is performed on the recipe selecting button SS2*a*, the controller performs a pop-up display of a third user interface UI3.

Figure 11:
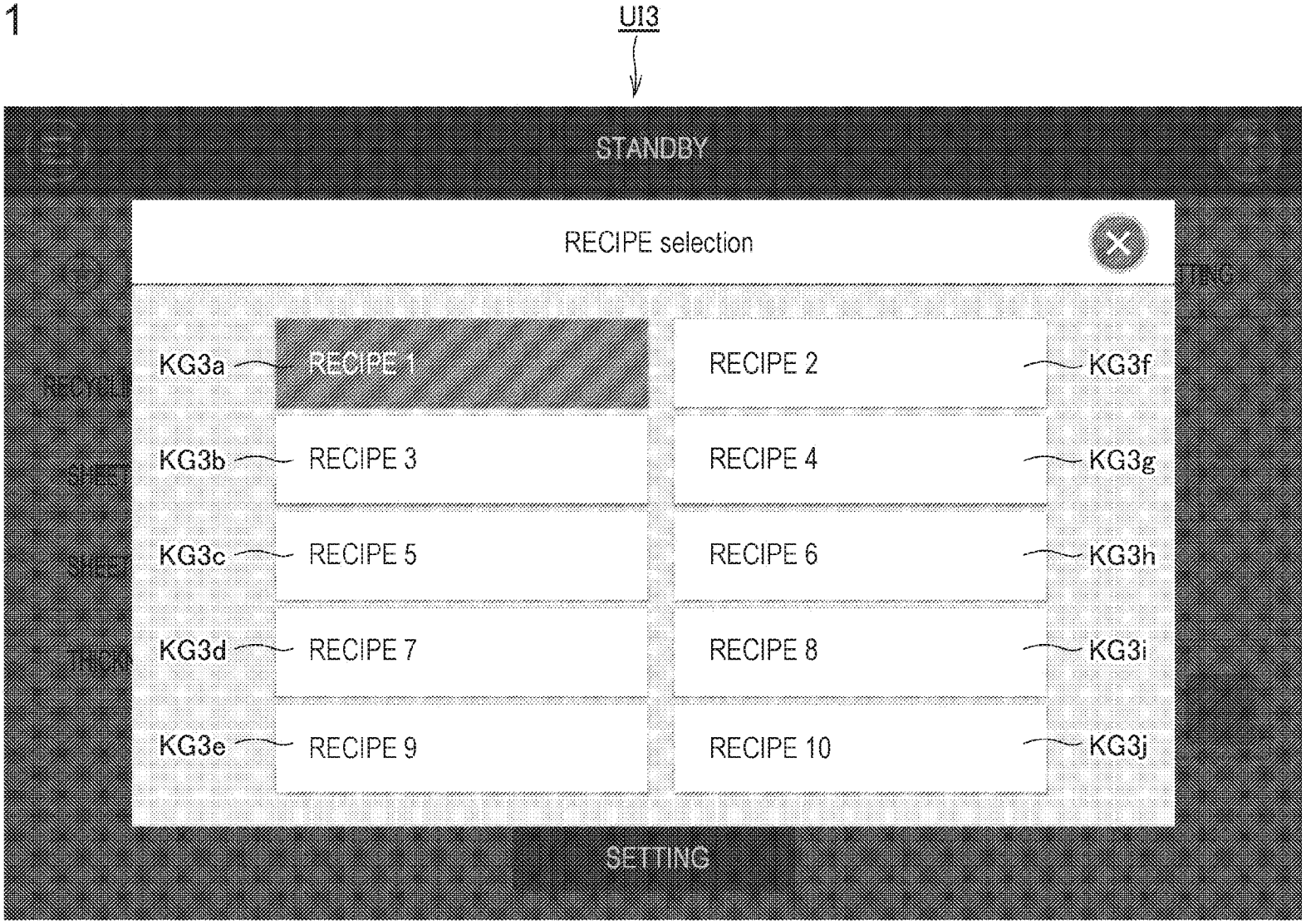
FIG. 11 is a view showing a third user interface.

FIG. 11 is a view showing the third user interface UI3.

As described above, the user is able to register the recipe 1 to the recipe 10 as the recipe in advance and is able to select one recipe as the recipe that is used in the manufacturing of the sheet from the ten recipes. The third user interface UI3 is a user interface for selecting one recipe from the ten recipes.

As shown in FIG. 11, in the third user interface UI3, ten item images KG3*a* to KG3*j* are displayed to correspond to the ten recipes 1 to 10, respectively. Each of the item images KG3*a* to KG3*j* is a touch operating button, and the user is able to select a recipe by conducting a touch operation on any image of the item images KG3*a* to KG3*j*.

The recipe selected on the third user interface UI3 is a setting target recipe by using the second user interface UI2. In addition, information indicating the selected recipe is displayed on the recipe selecting button SS2*a* of the second user interface UI2.

As shown in FIG. 10, an automatic stop-causing sheet number setting button SS2*b* is provided in an upper right portion of the second user interface UI2. The automatic stop-causing sheet number setting button SS2*b* is a touch operating button on which the touch operation is performed in a case of setting the automatic stop-causing sheet number. In addition, information indicating the currently set automatic stop-causing sheet number is displayed on the automatic stop-causing sheet number setting button SS2*b*. The user refers to the information displayed on the automatic stop-causing sheet number setting button SS2*b*, thereby, being able to recognize the currently set automatic atop-causing sheet number. In addition, in a case of setting the automatic stop-causing sheet number, the user conducts the touch operation on the automatic stop-causing sheet number setting button SS2*b*. When the controller 150 detects that the touch operation is performed on the automatic stop-causing sheet number setting button SS2*b*, the controller performs a pop-up display of a user interface on which it is possible to set the automatic stop-causing sheet number. The user is able to set the automatic stop-causing sheet number by using the corresponding user interface.

As shown in FIG. 10, a sheet size setting button SS2*c* is provided in a left portion of the second user interface UI2. The sheet size setting button SS2*c* is a touch operating button on which the touch operation is performed in a case of setting the sheet size. In addition, information indicating the currently set sheet size is displayed on the sheet size setting button SS2*c*. The user refers to the information displayed on the sheet size setting button SS2*c*, thereby, being able to recognize the currently set sheet size. In addition, in a case of setting the sheet size, the user conducts the touch operation on the sheet size setting button SS2*c*. When the controller 150 detects that the touch operation is performed on the sheet size setting button SS2*c*, the controller performs a pop-up display of a user interface on which it is possible to set the sheet size. The user is able to set the sheet size by using the corresponding user interface.

As shown in FIG. 10, a sheet type setting button SS2*d* is provided below the sheet size setting button SS2*c* in the left portion of the second user interface UI2. The sheet type setting button SS2*d* is a touch operating button on which the touch operation is performed in a case of setting the sheet type. In addition, information indicating the currently set sheet type is displayed on the sheet type setting button SS2*d*. The user refers to the information displayed on the sheet type setting button SS2*d*, thereby, being able to recognize the currently set sheet type. In addition, in a case of setting the sheet type, the user conducts the touch operation on the sheet type setting button SS2*d*. When the controller 150 detects that the touch operation is performed on the sheet type setting button SS2*d*, the controller performs a pop-up display of a user interface on which it is possible to set the sheet type. The user is able to set the sheet type by using the corresponding user interface.

As shown in FIG. 10, a sheet thickness setting button SS2*e* is provided below the sheet type setting button SS2*d* in the left portion of the second user interface UI2. The sheet thickness setting button SS2*e* is a touch operating button on which the touch operation is performed in a case of setting the sheet thickness. In addition, information indicating the currently set sheet thickness (as described above, a level indicating a degree of thickness) is displayed on the sheet thickness setting button SS2*e*. The user refers to the information displayed on the sheet thickness setting button SS2*e*, thereby, being able to recognize the currently set sheet thickness. In addition, in a case of setting the sheet thickness, the user conducts the touch operation on the sheet thickness setting button SS2*e*. When the controller 150 detects that the touch operation is performed on the sheet thickness setting button SS2*e*, the controller performs a pop-up display of a user interface on which it is possible to set the sheet thickness. The user is able to set the sheet thickness by using the corresponding user interface.

As shown in FIG. 10, a color setting region QR2 is formed in a right portion from an information display region of the second user interface UI2.

In the color setting region QR2, a specific color value setting screen IG2 (FIG. 10) for setting the yellow value, the magenta value, and the cyan value described above is displayed, in a case where the sheet type is the "regular paper (colored paper)" or the "cardboard (colored paper)", and the sheet that is manufactured by the sheet manufacturing apparatus 100 is the "colored paper".

On the other hand, in the color setting region QR2, a white value setting screen SG2 (FIG. 12) for setting the white value described above is displayed, in a case where the sheet type is the "regular paper (white paper)" or the "cardboard (white paper)", and the sheet that is manufactured by the sheet manufacturing apparatus 100 is the "white paper".

FIG. 10 shows the second user interface UI2 on which the specific color value setting screen IG2 is displayed.

As shown in FIG. 10, on the specific color value setting screen IG2, each currently set value of the yellow value, the magenta value, and the cyan value is displayed in a form of a bar BR2*a* having a length that changes depending on a magnitude of the value, and information JH2*a* indicating a specific value. Regarding each of the yellow value, the magenta value, and the cyan value, the user refers to a combination of the bar BR2*a* and the information JH2*a*, thereby, being able to easily and accurately recognize the currently set values. In addition, a decrement button DB2*a* for decrementing each value of the color setting values is displayed as a touch operating button on a left side of a left end portion of each bar BR2*a*. In addition, an increment button IB2*a* for incrementing each value of the color setting values is displayed on a right side of a right and portion of each bar BR2*a*. Regarding each of the yellow value, the magenta value, and the cyan value, the user conducts simple work of the touch operation on the decrement button DB2*a* and the increment button IB2*a*, thereby, being able to set a desired value in a range of "0" to "4".

A combination of the bar BR2*a*, the increment button IB2*a*, and the decrement button DB2*a* corresponds to an "operation object".

As shown in FIG. 10, color selecting buttons EB2*a* to EB2*f*, on which rectangular objects filled with respective colors are displayed, are displayed in a right portion of the specific color value setting screen IG2, regarding six colors (in the embodiment, red, violet, pink, green, yellow, and blue). The color selecting buttons EB2*a* to EB2*f* are respective touch operating buttons. The color selecting buttons EB2*a* to EB2*f* correspond to the respective "operation objects".

When a touch operation is performed on any one button of the six color selecting buttons EB2*a* to EB2*f*, the yellow value, the magenta value, and the cyan value are automatically adjusted such that the sheet to be manufactured has a color approximate to a color corresponding to the touch-operated button. For example, a color corresponding to the color selecting button EB2*a* is red. When a touch operation is performed on the color selecting button EB2*a*, the yellow value, the magenta value, and the cyan value are automatically adjusted such that the sheet to be manufactured has a color approximate to red. In addition, each of the color bars BR2*a* and information JH2*a* have information obtained by reflecting the automatically adjusted yellow value, magenta value, and cyan value.

Here, in a case where the user wants to manufacture a sheet having a predetermined color, it is easy to assume that the user does not accurately recognize an appropriate compounding ratio of yellow, magenta, and cyan which are supplied to the raw material, in many cases. Based on this, according to the embodiment, the user conducts simple work of the touch operation on any one of the color selecting buttons EB2*a* to EB2*f*, and thereby it is possible to obtain the sheet to be manufactured which has a color approximate to at least any color of the six colors. Further, the user is able to conduct the touch operation on the color selecting buttons EB2*a* to EB2*f* and, then, further adjust the yellow value, the magenta value, and the cyan value by using the decrement button DB2*a* and the increment button IB2*a*, and thus it is possible to obtain the sheet to be manufactured which has a color approximate to a desired color with high accuracy.

The color corresponding to each of the color selecting buttons EB2*a* to EB2*f* is only an example and may include another color. However, six colors of red, violet, pink, green, and blue corresponding to the color selecting buttons EB2*a* to EB2*f* of the embodiment are representative colors employed as a color of the sheet and are suitable as selectable colors by the color selecting buttons EB2*a* to EB2*f*.

Figure 12:
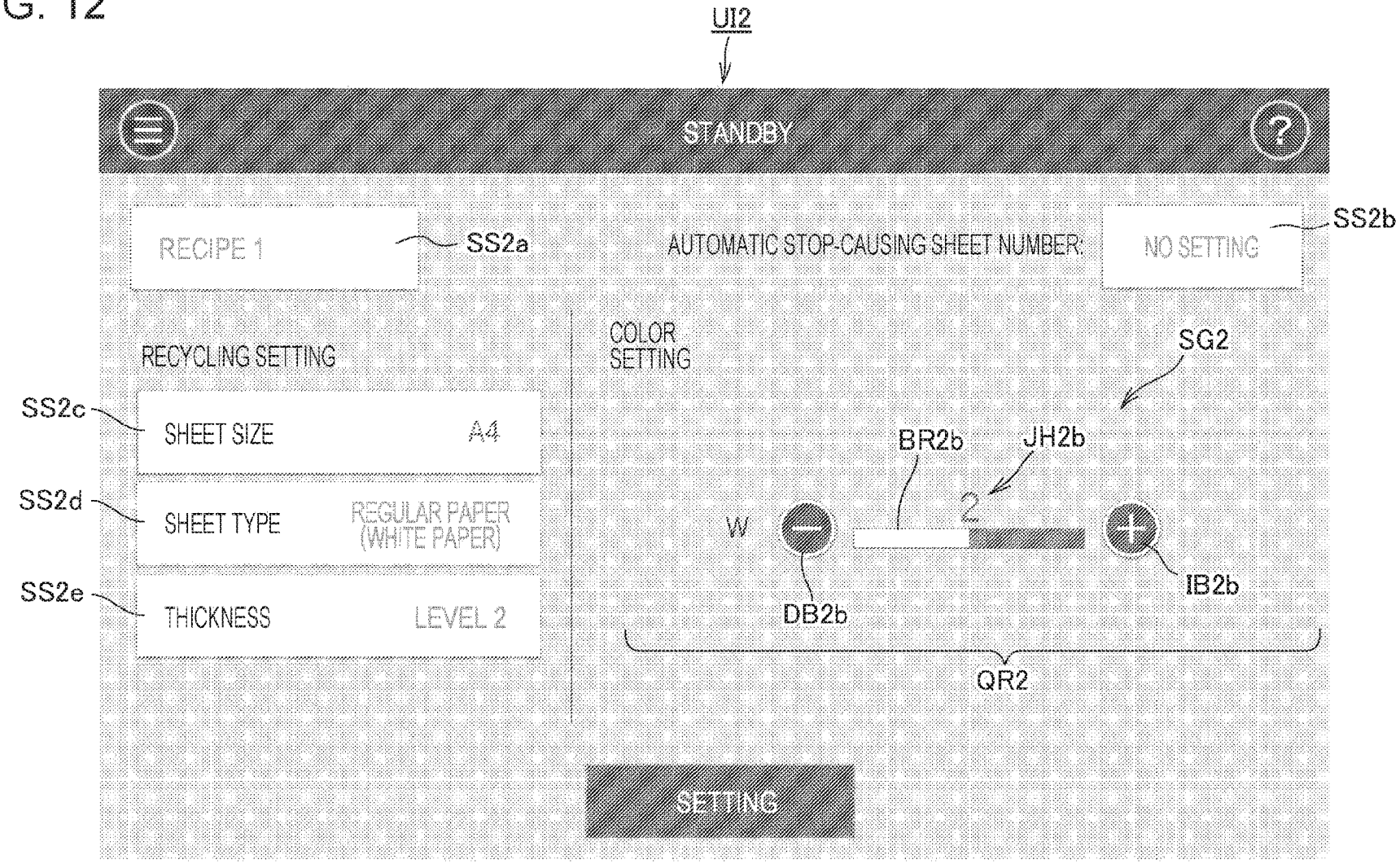
FIG. 12 is a view showing the second user interface.

FIG. 12 shows the second user interface UI2 on which the white value setting screen 802 is displayed.

As shown in FIG. 12, on the white value setting screen SG2, the currently set value of the white value is displayed in a form of a bar BR2*b* having a length that changes depending on a magnitude of the value and information JH2*b* indicating a specific value. Regarding the white value, the user refers to a combination of the bar BR2*b* and the information JH2*b*, thereby, being able to easily and accurately recognize the currently set value. In addition, a decrement button DB2*b* for decrementing the value of the white-color setting value is displayed as a touch operating button on a left side of a left end portion of the bar BR2*b*. In addition, an increment button IB2*b* for incrementing the value of the white-color setting value is displayed on a right side of a right end portion of the bar BR2*b*. Regarding the white value, the user conducts simple work of the touch operation on the decrement button DB2*b* and the increment button IB2*b*, thereby, being able to set a desired value in a range of "0" to "4".

A combination of the bar BR2*b*, the increment button IB2*b*, and the decrement button DB2*b* corresponds to an "operation object".

The controller 150 records, in the setting data 121, the color setting value (the yellow value, the magenta value, and the cyan value in a case where the sheet is the "colored paper" and the white value in a case where the sheet is the "white paper") set by the user using the second user interface UI2 and an accompanying user interface.

Similarly, the controller 150 also records, in the setting data 121, information indicating a recipe (the recipe 1 to the recipe 10) selected by the user or a setting value (the automatic stop-causing sheet number, the sheet size, the sheet type, and the sheet thickness) other than the color setting values.

Next, a process of the sheet manufacturing apparatus 100 in a case where the resin supply unit 52 supplies a resin to the raw material will be described.

In the following description, in the process of manufacturing the sheet, a process (for example, a process of rough crushing, a process of defibrating, or the like) other than the process related to supplying the resin by the resin supply unit 52 is appropriately executed at an appropriate timing, and thus the description thereof is omitted.

Hereinafter, a process of supplying the resin by the resin supply unit 52 is properly referred to as a "resin supply process".

In addition, in the following description, the yellow value, the magenta value, and the cyan value are collectively referred to as a "specific color value".

In addition, in the following description, in a case where the screw feeders 508*a* to 508*f* are not distinguished, the screw feeders are referred to as the "screw feeder SF".

Figure 13:
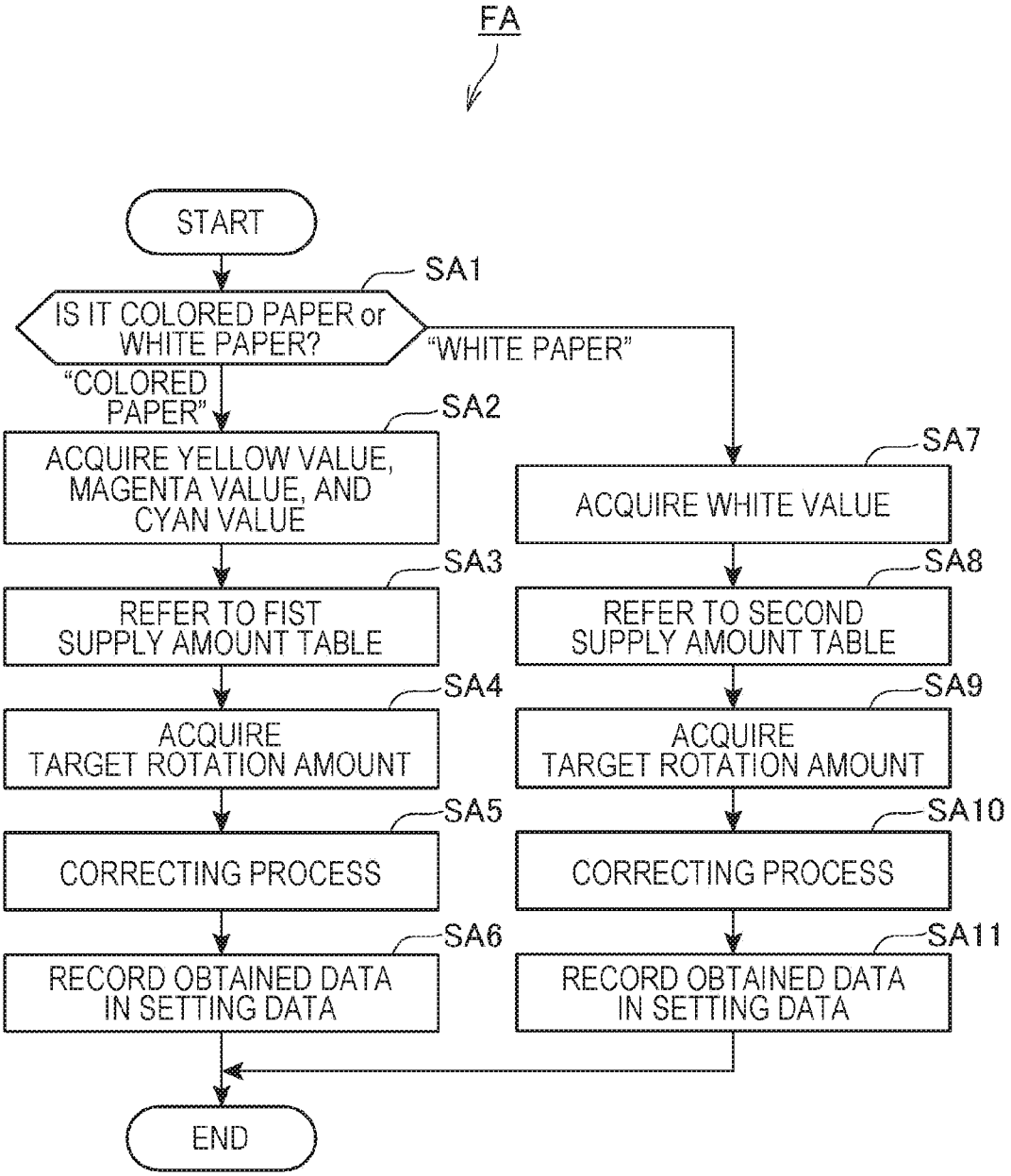
FIG. 13 is a flowchart showing an operation of the sheet manufacturing apparatus.

A flowchart FA in FIG. 13 is a flowchart showing a process executed by the sheet manufacturing apparatus 100 before the resin supply process is executed.

The controller 150 executes processes shown in the flowchart in FIG. 13 at a predetermined timing before the resin supply process is executed. For example, the predetermined timing before execution of the resin supply process is the time of execution of an initial process that is performed after the power switch H7 turns ON, and the timing is set depending on an instruction from the user, in some cases.

As shown in the flowchart FA in FIG. 13, the controller 150 determines whether the sheet to be manufactured is the "colored paper" or the "white paper" with reference to the setting data 121 (Step SA1). In Step SA1, the controller 150 determines that the sheet to be manufactured is the "colored paper" in a case where the sheet type is set as "regular paper (colored paper)" or "cardboard (colored paper)", and the controller 150 determines that the sheet to be manufactured is the "white paper" in a case where the sheet type is set as "regular paper (white paper)" or "cardboard (white paper)".

In a case where the sheet to be manufactured is the "colored paper" (Step SA1: "colored paper"), the controller 150 refers to the setting data 121 and acquires the yellow value, the magenta value, and the cyan value (Step SA2). As described above, regarding the yellow value, the magenta value, and the cyan value, new values set by the user are recorded in the setting data 121.

Subsequently, the controller 150 refers to the first supply amount table TB1 stored in the non-volatile storage unit 120 (Step SA3).

FIG. 14 is a diagram schematically showing content of the first supply amount table TB1.

The first supply amount table TB1 is a table in which a combination and information indicating each rotation amount (hereinafter, referred to as a "target rotation amount") of the screw feeder SF corresponding to each color at the time of the execution of the resin supply process are stored in an associated manner with respect to each combination of the yellow value, the magenta value, and the cyan value. In the embodiment, the target rotation amount is described as a ratio of a rotation amount of the screw feeder SF at the time of the resin supply process to the maximum rotation amount of the screw feeder SF. In the embodiment, the "rotation amount of the screw feeder SF" means the rotation amount of the screw feeder SP per unit time, unless otherwise described.

In the first supply amount table TB1, the target rotation amount of the screw feeder SF of each color for each combination of the yellow value, the magenta value, and the cyan value in a case where the sheet thickness is a predetermined level (for example, level 5), and the sheet to be manufactured is any one (for example, regular paper) of the "regular paper" and the "cardboard" is stored. The target rotation amount is corrected according to a sheet thickness that is actually set and a sheet type that is actually set through a correction process to be described below.

As well known, the rotation amount of the screw feeder and an amount of a medium (in this example, resin) that is supplied by the screw feeder have a substantially proportional relationship. Based on this, the target rotation amount indicates the amount of resin that is supplied in the resin supply process.

For example, in FIG. 14, a record R1 of the first supply amount table TB1 is a record corresponding to a case where (yellow value, magenta value, cyan value) is (1, 0, 0). The record R1 shows that, in a case where (yellow value, magenta value, cyan value) is (1, 0, 0), at the time of the execution of the resin supply process, the target rotation amount of the screw feeder 508*a* of the first uncolored color is "60%", the target rotation amount of the screw feeder 508*b* of the second uncolored color is "50%", the target rotation amount of the screw feeder 508*c* of white is "0%", the target rotation amount of the screw feeder 508*d* of yellow is "10%", the target rotation amount of the screw feeder 508*e* of magenta is "0%", and the target rotation amount of the screw feeder 508*f* of cyan is "0%".

Here, the target rotation amount of each color for each combination of the specific color values (the yellow value, the magenta value, and the cyan value) is appropriately determined based on a result of a pre-test or simulation in accordance with the following three rules (a first rule, a second rule, and a third rule).

<First Rule>

The first rule is as follows. In other words, the target rotation amount of each color for each combination of the specific color values is determined such that a ratio of a total supply amount of the resin, which is to be supplied, to a predetermined unit weight of raw material, which is conveyed through the pipe 54, at the time of execution of the resin supply process is set to a predetermined ratio that does not exceed a first threshold value. Hereinafter, the predetermined ratio that does not exceed the first threshold value is referred to as a "total amount ratio".

For example, the first threshold value is a predetermined value within a range of "5%" to "30%". In a case where the first threshold value is "15%", the total amount ratio becomes "13%" as an example. In a case where the total amount ratio is "13%", the target rotation amount of each color for each combination of the specific color values is determined such that the ratio of the total supply amount of the resin, which is to be supplied, to a predetermined unit weight of raw material which is conveyed through the pipe 54 is set to "13%" (including a value approximate to "13%"). In this case, in the resin supply process, about 13 grams of resin is supplied as a total amount of resin to 100 grams of raw material.

<Second Rule>

The second rule is as follows. In other words, the target rotation amount of each color for each combination of the specific color values is determined such that a ratio of a supply amount of a colored resin to a total supply amount of resin that is supplied to a predetermined unit weight of raw material in the resin supply process does not exceed a second threshold value.

For example, the second threshold value is a predetermined value within a range of "15%" to "50%". In a case where the second threshold value is "33%", and 10 grams of resin is supplied as the total amount of resin with respect to 100 grams of the raw material, the target rotation amount of each color for each combination of the specific color values is determined such that an amount of each of yellow, magenta, and cyan resins, which are supplied to 100 grams of raw material does not exceed about 3.3 grams.

<Third Rule>

The third rule is as follows. In other words, the target rotation amount of the first uncolored color and the second uncolored color for each combination of the specific color values is determined such that a value obtained by subtracting the "total supply amount of yellow, magenta, and cyan resins which are supplied to the predetermined unit weight of raw material" from the "total supply amount of resin that is supplied to the predetermined unit weight of raw material in the resin supply process" is the "total supply amount of the first uncolored resin and the second uncolored resin". As described above, the "total supply amount of resin that is supplied to a predetermined unit weight of raw material in the resin supply process" is determined in accordance with the first rule.

The target rotation amount of the first uncolored color and the second uncolored color for each combination of the specific color values is determined in accordance with the third rule. As a result, a weight of resin corresponding to the total amount ratio is supplied to the predetermined unit weight of raw material in the resin supply process.

Distribution of the target rotation amount with respect to the first uncolored color and the second uncolored color is appropriately determined based on results of a pre-test or simulation by reflecting a difference or the like between components of two color resins.

As described above, each target rotation amount of each record of the first supply amount table TB1 is determined in accordance with the first to third rules. As a result, even in a case where the resin supply process is performed, based on any record of the first supply amount table TB1, the "ratio of the total supply amount of resin that is supplied to the predetermined unit weight of raw material" becomes the "total amount ratio that does not exceed the first threshold value" (including a value approximate to the ratio). In addition, a ratio of a supply amount of a colored resin to the total supply amount of the resins which are supplied to the predetermined unit weight of raw material does not exceed the second threshold value.

The first threshold value, the second threshold value, and the total amount ratio described above are appropriately determined, based on the results of a test or simulation, from a viewpoint of appropriate sheet manufacturing by the sheet manufacturing apparatus 100. The first threshold value, the second threshold value, and the total amount ratio may be a fixed value or a variable value. For example, a predetermined reference value may be corrected by reflecting a state of the raw material (used paper) or a component of a resin to be supplied, or the predetermined reference value may be corrected by reflecting a status of aged deterioration, an environment (temperature, humidity, or another factor influencing sheet manufacturing).

As shown in FIG. 13, the controller 150 refers to the first supply amount table TB1 in Step SA3 and, then, acquires the target rotation amount of the screw feeder SF corresponding to each color based on the first supply amount table TB1 (Step SA4). In Step SA4, the controller 150 identifies a record corresponding to a combination of the yellow value, the magenta value, and the cyan value acquired in Step SA2. Subsequently, the controller 150 acquires the target rotation amount of the screw feeder SF for each color based on the identified record.

A result of "0%" of the target rotation amount is "0%" means that the screw feeder SF does not rotate. Based on this, in Step SA4, the controller 150 executes a process of selecting the resin cartridge XT as the supply source of resin in the supply of resin by the resin supply unit 52. The same is true of Step SA9 to be described below.

Subsequently, the controller 150 executes a correcting process (Step SA5). In the correcting process in Step SA5, the controller 150 corrects the target rotation amount of the screw feeder SF corresponding to each color, which is acquired in Step SA4, depending on the setting of the sheet thickness and the sheet type ("regular paper" or "cardboard"). From a viewpoint of manufacturing a sheet having the set sheet thickness and sheet type, the correction amount is appropriately determined by reflecting a result of a pre-test or simulation.

In the sheet manufacturing apparatus 100, in a case where it is possible to set a conveying speed of the raw material that is conveyed through the pipe 54, the correction process may be configured to perform correction such that a substantially constant amount of resin is supplied to the predetermined unit weight of raw material regardless of the conveying speed.

Subsequently, the controller 150 records the target rotation amount of the screw feeder SF corresponding to each color, which is obtained after correction by the correcting process in Step SA5, as a setting value, in the setting data 121 (Step SA6).

As will be described below, in the execution of the resin supply process, the controller 150 rotates the screw feeder SF corresponding to each color such that the rotation amount of the screw feeder SF corresponding to each color, which is recorded as the setting value in the setting data 121, becomes the target rotation amount.

As described above, in the embodiment, in a case of manufacturing the colored sheet, the supply amount of each colored sheet (the rotation amount of the screw feeder SF corresponding to each color) is automatically set, based on the yellow value, the magenta value, and the cyan value set by the user, in accordance with the first to third rules. Here, the first threshold value, the total amount ratio, and the second threshold value in each rule are appropriate values determined based on a result of a pre-test or simulation, from a viewpoint of manufacturing an appropriate sheet having an appropriate color. Based on this, each colored resin is supplied by a supply amount determined in accordance with the first to third rules in the resin supply process. In this manner, each colored resin is appropriately supplied, and an appropriate sheet having an appropriate color is manufactured. In this respect, regarding the yellow value, the magenta value, and the cyan value, work conducted by the user is the simple work of selecting any value from values of "0" to "4". As described above, the user particularly sets the yellow value, the magenta value, and the cyan value by using the user interface displayed on the touch panel H5 with ease and accuracy. Therefore, very high user convenience is achieved.

In addition, as shown in the second user interface UI2, information about the first uncolored color and the second uncolored color is not displayed on the screen for setting the yellow value, the magenta value, and the cyan value. As described above, this is because the supply amount of the first uncolored resin and the second uncolored resin is automatically set depending on the setting related to the specific color value. As described in the embodiment, information about the first uncolored color and the second uncolored color is not displayed on the second user interface UI2, and thereby it is possible not to provide the user with unnecessary information about a color that does not need to be set by the user.

However, a configuration may be employed, in which, on the second user interface UI2, the information about the first uncolored resin and the second uncolored resin, particularly, information of supply amounts of the resins, may be displayed. For example, a configuration may be employed, in which estimation of supply amounts of the first uncolored resin and the second uncolored resin is displayed as values depending on the setting of the specific color value by the user. In the configuration, the user is able to easily and accurately recognize consumption of the first uncolored resin and the second uncolored resin and how much the resins are consumed.

On the other hand, in a case where the sheet to be manufactured is determined to be "white paper" in Step SA1 of the flowchart FA in FIG. 13 (Step SA1: "white paper"), the controller 150 refers to the setting data 121 and acquires the white value (Step SA7). As described above, regarding the white value, a new value set by the user is recorded in the setting data 121.

Subsequently, the controller 150 refers to the second supply amount table TB2 stored in the non-volatile storage unit 120 (Step SA8).

FIG. 15 is a diagram schematically showing content of the second supply amount table TB2.

The second supply amount table TB2 is a table in which the white value and information indicating each target rotation amount of the screw feeder SF corresponding to each color at the time of the execution of the resin supply process are stored in an associated manner with respect to each of the white values ("0" to "4").

Similarly to the first supply amount table TB1, in the second supply amount table TB2, the target rotation amount of the screw feeder SF of each color for each white value in a case where the sheet thickness is a predetermined level (for example, level 5), and the sheet to be manufactured is any one (for example, regular paper) of the "regular paper" and the "cardboard" is stored.

For example, in FIG. 15, a record R2 of the second supply amount table TB2 is a record corresponding to a case where the "white value" is "4". The record R2 shows that, in a case where the "white value" is "4", at the time of the execution of the resin supply process, the target rotation amount of the screw feeder 508*a* of the first uncolored color is "20%", the target rotation amount of the screw feeder 508*b* of the second uncolored color is "20%", the target rotation amount of the screw feeder 508*c* of white is "80%", the target rotation amount of the screw feeder 508*d* of yellow is "0%", the target rotation amount of the screw feeder 508*e* of magenta is "0%", and the target rotation amount of the screw feeder 508*f* of cyan is "0%".

The target rotation amount of each color for each white value is appropriately determined based on a result of a pre-test or simulation in accordance with at least the first rule and third rule.

In other words, the target rotation amount of each color for each combination of the white values is determined such that a ratio of a total supply amount of the resin, which is to be supplied, to a predetermined unit weight of raw material, which is conveyed through the pipe 54, at the time of execution of the resin supply process is set to the total amount ratio that does not exceed the first threshold value (the first rule). In addition, the target rotation amount of the first uncolored color and the second uncolored color for each white color is determined such that a value obtained by subtracting the "total supply amount of a white resin which is supplied to the predetermined unit weight of raw material" from the "total supply amount of resin that is supplied to the predetermined unit weight of raw material in the resin supply process" is the "total supply amount of the first uncolored resin and the second uncolored resin". As a result, in the resin supply process, a weight of resin corresponding to the total amount ratio is supplied to the predetermined unit weight of raw material.

Subsequently, the controller 150 acquires the target rotation amount of the screw feeder SF corresponding to each color based on the second supply amount table TB2 (Step SAG). In Step SA9, the controller 150 identifies a record corresponding to the combination of the white values acquired in Step SA7. Subsequently, the controller 150 acquires the target rotation amount of the screw feeder SF for each color based on the identified record.

Subsequently, the controller 150 executes a correcting process (Step SA10). In the correcting process in Step SA10, in the same method of Step SA5, the controller 150 corrects the target rotation amount of the screw feeder SF corresponding to each color, which is acquired in Step SA9, depending on the setting of the sheet thickness and the sheet type ("regular paper" or "cardboard").

Subsequently, the controller 150 records the target rotation amount of the screw feeder SF corresponding to each color, which is obtained after correction by the correcting process in Step SA5, as a setting value, in the setting data 121 (Step SA11).

As described above, the process executed by the sheet manufacturing apparatus 100 before the execution of the resin supply process is described using the flowchart FA. The process described by the flowchart FA corresponds to a "process of selecting the resin cartridge KT which is the supply source of the resin, when the resin supply unit 52 supplies the resin, and performing setting related to the supply amount of the resin for each of the selected resin cartridges.

Next, the resin supply process will be described.

Figure 16:
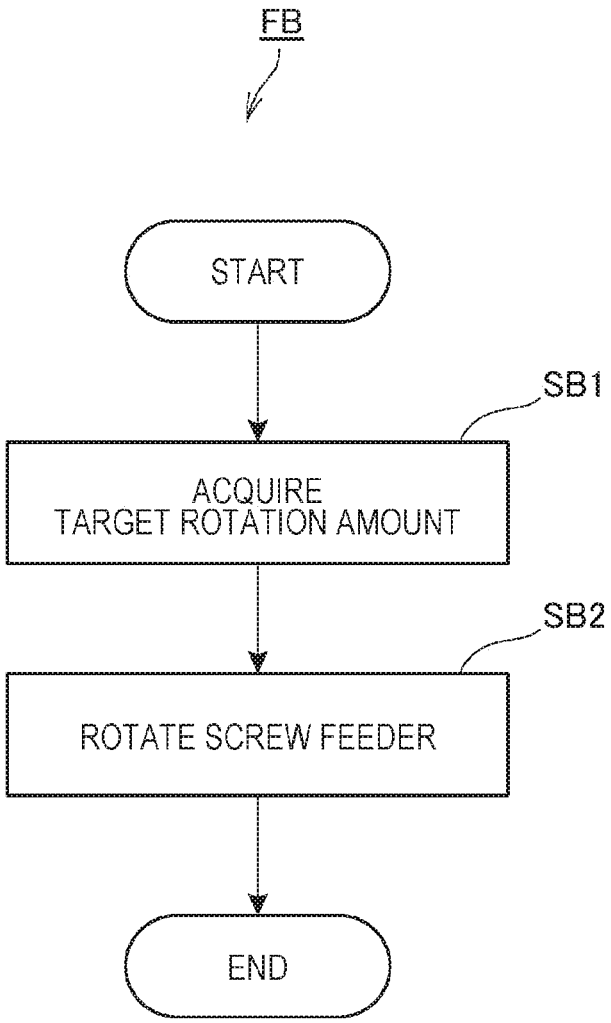
FIG. 16 is a flowchart showing an operation of the sheet manufacturing apparatus.

A flowchart FB in FIG. 16 is a flowchart showing an operation of the sheet manufacturing apparatus 100 when the resin supply process is executed.

A start time point of the flowchart FB is a time point when the process of the flowchart FA is executed to set the target rotation amount of the screw feeder SF corresponding to each color in the resin supply process.

As shown in FIG. 16, at the time of the resin supply process, the controller 150 refers to the setting data 121 and acquires each target rotation amount of the screw feeder SF corresponding to each color (Step SB1).

Subsequently, the controller 150 controls the resin conveying units 510*a* to 510*f* of the resin supply unit 52 so as to rotate the screw feeder SF corresponding to each color such that the rotation amount of the screw feeder SF corresponding to each color becomes the corresponding target rotation amount (Step SB2). As a result, an appropriate amount of resin is supplied to the predetermined unit weight of raw material that is conveyed through the pipe 54.

In Step SB2, the controller 150 reflects a state of the raw material that is conveyed through the pipe 54 based on a detection value from a predetermined sensor so as to rotate the screw feeder SF at an appropriate timing or stop the rotation.

As described above, the sheet manufacturing apparatus 100 according to the embodiment is a device that is capable of manufacturing a predetermined colored sheet and includes the plurality of resin cartridges KT that store a plurality of colored resins, respectively. In addition, the sheet manufacturing apparatus 100 includes the resin supply unit 52 that supplies the resin from one or the plurality of resin cartridges KT to a predetermined raw material in a predetermined step of manufacturing the sheet. In addition, the sheet manufacturing apparatus 100 includes the controller 150 that selects the resin cartridge KT which is the supply source of the resin, when the resin supply unit 52 supplies the resin, and performs setting related to the supply amount of the resin for each of the selected resin cartridges KT, based on the setting related to the color of the sheet to be manufactured.

According to the configuration, the controller 150 selects the resin cartridge KT that supplies the resin, and sets the supply amount of the resin based on the setting related to the color of the sheet to be manufactured, the resin is supplied based on the setting, and thereby it is possible to perform an appropriate resin supply in a step of mixing the raw material and one or the plurality of colored resins.

In addition, in the embodiment, the sheet manufacturing apparatus 100 includes the resin cartridge KT (uncolored resin cartridge) that stores a first uncolored resin and a second uncolored resin which are uncolored resins, and a resin cartridge KT (colored resin cartridge) that stores a white resin, a yellow resin, a magenta resin, or a cyan resin (colored resin), which is a resin that is colored. The controller 150 selects the uncolored resin cartridge and the colored resin cartridge together as selecting targets as the resin cartridge KT of the supply sources of the resin.

According to the configuration, the sheet manufacturing apparatus 100 is capable of mixing the uncolored resin and the raw material properly so as to manufacture the sheet appropriately during manufacture of the sheet having the predetermined color.

In addition, in the embodiment, when performing setting related to the supply amount of the resin for each of the selected resin cartridges KT, in a case where the sheet to be manufactured is colored paper, the controller 150 determines the total supply amount of all of the resins such that the ratio of the total supply amount of all of the resins to the weight of the predetermined raw material does not exceed the first threshold value. The controller determines the supply amounts of each of the yellow, magenta, and cyan resins such that the ratio of the supply amount of one specific colored resin to the determined total supply amount of all of the resins does not exceed the second threshold value. The controller determines, as the supply amount of the uncolored resin, the amount corresponding to a difference between the total of determined supply amount of all of the resins and the total determined supply amounts of the colored resins.

In the configuration, in a case where a sheet of colored paper is manufactured, the controller 150 is capable of supplying an appropriate resin in the step of mixing the raw material and the one or plurality of colored resins.

In addition, in the embodiment, the controller 150 displays the second user interface UI2 for executing the setting related to the color of the sheet to be manufactured.

In the configuration, the user can use the second user interface UI2 so as to set the color of the sheet to be manufactured, with ease and accuracy.

In addition, in the embodiment, the controller 150 displaces the operation object (the combination of the bar BR2*a*, the increment button IB2*a*, and the decrement button DB2*a*, or a combination of the bar BR2*b*, the increment button IB2*b*, and the decrement button DB2*b*) for setting the supply amount for each color of the resin cartridge KT corresponding to the colored resin on the second user interface UI2. The controller 150 selects the resin cartridge KT which is the supply source of the resin, when the resin supply unit 52 supplies the resin, and performs setting related to the supply amount of the resin for each of the selected resin cartridge KT, based on an operation performed through the operation object.

In the configuration, the user operates the operation object, and thereby it is possible to adjust the supply amount for each color of the resin cartridge KT corresponding to the colored resin and set the color of the sheet to be manufactured, with ease and accuracy.

In addition, in the embodiment, the controller 150 does not display the operation object for adjusting the supply amount of the uncolored resin in the second user interface UI2.

In the configuration, the information about the uncolored resins (the first uncolored resin and the second uncolored resin) is not displayed in the second user interface UI2, and thereby it is possible not to provide the user with unnecessary information about a color that does not need to be set by the user.

In addition, in the embodiment, the controller 150 displays the second user interface UI2 that has the operation objects (color selecting buttons EB2*a* to EB2*f*) for displaying a selectable color of the sheet to be manufactured, selects the resin cartridge KT, which is the supply source of the resin, when the resin supply unit 52 supplies the resin, based on the operation on the operation object, and performs setting related to the supply amount of the resin for each of the selected resin cartridges KT, based on an operation performed through the operation object.

In the configuration, the user uses the operation object so as to perform simply work of selecting the color of the sheet to be manufactured, and thereby it is possible to perform setting related to the color of the sheet to be manufactured, with ease and accuracy.

In addition, the resin supply unit 52 has resin conveying units 510*a* to 510*f* that convey the resin to a supply destination for each resin cartridge KT. The controller 150 controls the resin conveying units 510*a* to 510*f* based on the setting related to the supply amount of the resin for each of the resin cartridges KT.

In the configuration, the controller 150 controls the resin conveying units 510*a* to 510*f* so as to adjust the conveyance amount of the resin, and thereby it is possible to supply an appropriate amount of the resin based on the setting related to the supply amount of the resin.

In addition, in the embodiment, the resin conveying units 510*a* to 510*f* include the screw feeders 508*a* to 508*f*. The controller 150 controls a rotation speed of the screw feeder SF provided in the resin conveying units 510*a* to 510*f* based on the setting related to the supply amount of resin for each of the resin cartridges KT.

In the configuration, the controller 150 is capable of supplying an appropriate amount of resin based on the setting related to the supply amount of resin by using the screw feeder SF.

Modification Example 1

Next, a first modification example (Modification example 1) of the second user interface UI2 will be described.

Figure 17:
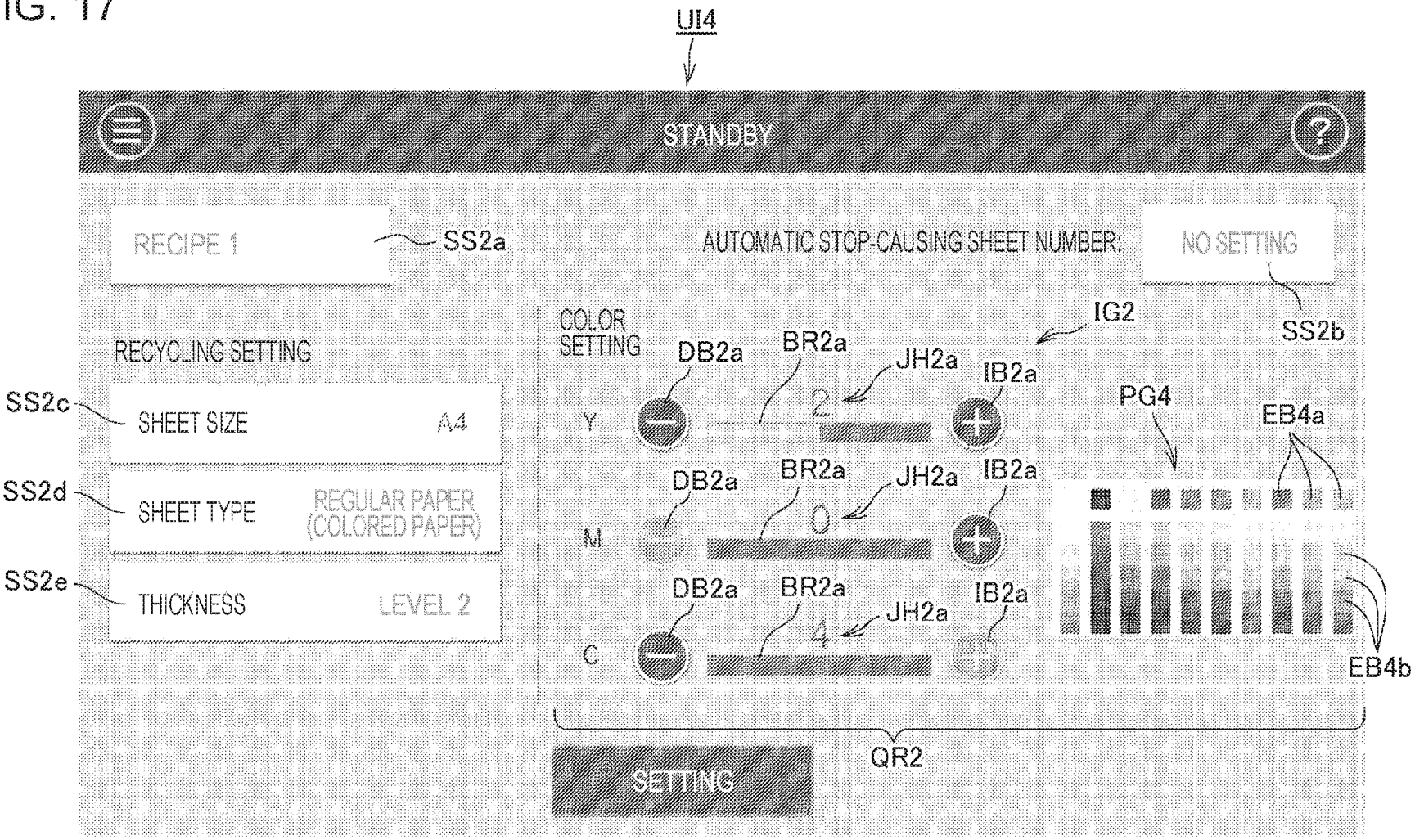
FIG. 17 is a view showing a fourth user interface.

FIG. 17 is a view showing the fourth user interface UI4 which is the first modification example of the second user interface UI2. In the fourth user interface UI4 in FIG. 17, the same reference signs are assigned to the same configurational elements as those in the second user interface UI2 in FIG. 10, and thus the description thereof is omitted.

As clarified in a comparison between FIG. 17 and FIG. 10, on the fourth user interface UI4 shown in FIG. 17, a color palette image PG4 is displayed, instead of the color selecting buttons EB2*a* to EB2*f* on the second user interface UI2.

As shown in FIG. 17, the color pallet image PG4 has ten representative color selecting buttons EB4*a* that are arranged in a right-left direction in an upper portion of the image. The representative color selecting buttons EB4*a* are rectangular touch operating buttons filled with ten different colors, respectively. The colors of the representative color selecting buttons EB4*a* are representative colors which are employed as colors of the sheet to be manufactured.

Further, the color pallet image PG4 has five related color selecting buttons EB4*b* which are associated with the representative color selecting buttons EB4*a* and arranged in a vertical direction. The related color selecting buttons EB4*b* are rectangular operation buttons filled with five colors obtained by changing hue, brightness, and chromaticness of the colors of the corresponding representative color selecting buttons EB4*a* little by little.

The user conducts the touch operation on any one of the representative color selecting buttons EB4*a* and the related color selecting buttons EB4*b* of the color pallet image PG4, thereby, being able to select the color of the sheet to be manufactured by the sheet manufacturing apparatus 100. When an operation on any one touch operating button of the representative color selecting buttons EB4*a* and the related color selecting buttons EB4*b* is detected, the controller 150 adjusts the yellow value, the magenta value, and the cyan value automatically such that the color of the sheet to be manufactured is a color approximate to a color corresponding to the touch-operated touch operating button. In addition, the controller 150 causes the color bars BR2*a* and the information JH2*a* to have information obtained by reflecting the automatically adjusted yellow value, magenta value, and cyan value.

As described above, in a case where the user wants to manufacture a sheet having a predetermined color, it is easy to assume that the user does not accurately recognize an appropriate compounding ratio of yellow, magenta, and cyan which are supplied to the raw material, in many cases. On the fourth user interface UI4, the user conducts simple work of the touch operation on any one of the representative color selecting buttons EB4*a* corresponding to desired colors and the related color selecting buttons EB4*b*, thereby, being able to conduct setting related to color with ease and accuracy, similarly to the second user interface UI2.

Here, the sheet to be manufactured by the sheet manufacturing apparatus 100 is used for printing, in some cases. The color of the sheet to be manufactured includes a color suitable for printing or a color unsuitable for printing. For example, in a case where black dots are formed on the sheet so as to print an image, a color, on which it is difficult to see the black dots, is not suitable for the color of the sheet. Based on this, in a case where the user selects a color that is not suitable for printing by using the color pallet image PG4, the controller 150 may be configured to display a warning indicating that the color is not suitable for the printing on the fourth user interface UI4.

In addition, a configuration may be employed, in which a button corresponding to a suitable color for the printing of the representative color selecting buttons EB4*a* and the related color selecting buttons EB4*b* of the image pallet image PG4 is displayed along with information indicating that the color is not suitable, in advance. For example, a configuration may be employed, in which each of the representative color selecting buttons EB4*a* corresponding to colors suitable for printing and the related color selecting buttons EB4*b* is surrounded in a dotted line frame.

In addition, as shown above, it is necessary to set each of the yellow, magenta, and cyan resins such that a ratio of a supply amount of one colored resin to the total supply amount of resins that are supplied to the predetermined unit weight of raw material in the resin supply process does not exceed the second threshold value (second rule). Based on this, in a case where the user manufactures the sheet having a color selected by using the color pallet image PG4, and the ratio of the supply amount of at least one colored resin (any one of yellow, magenta, or cyan) to the total supply amount of resins that are supplied to the predetermined unit weight of raw material exceeds the second threshold value, the controller 150 may be configured to notify the user that the color of the sheet is not suitable for use.

Modification Example 2

Next, a second modification example (Modification example 2) of the second user interface UI2 will be described.

Figure 18:
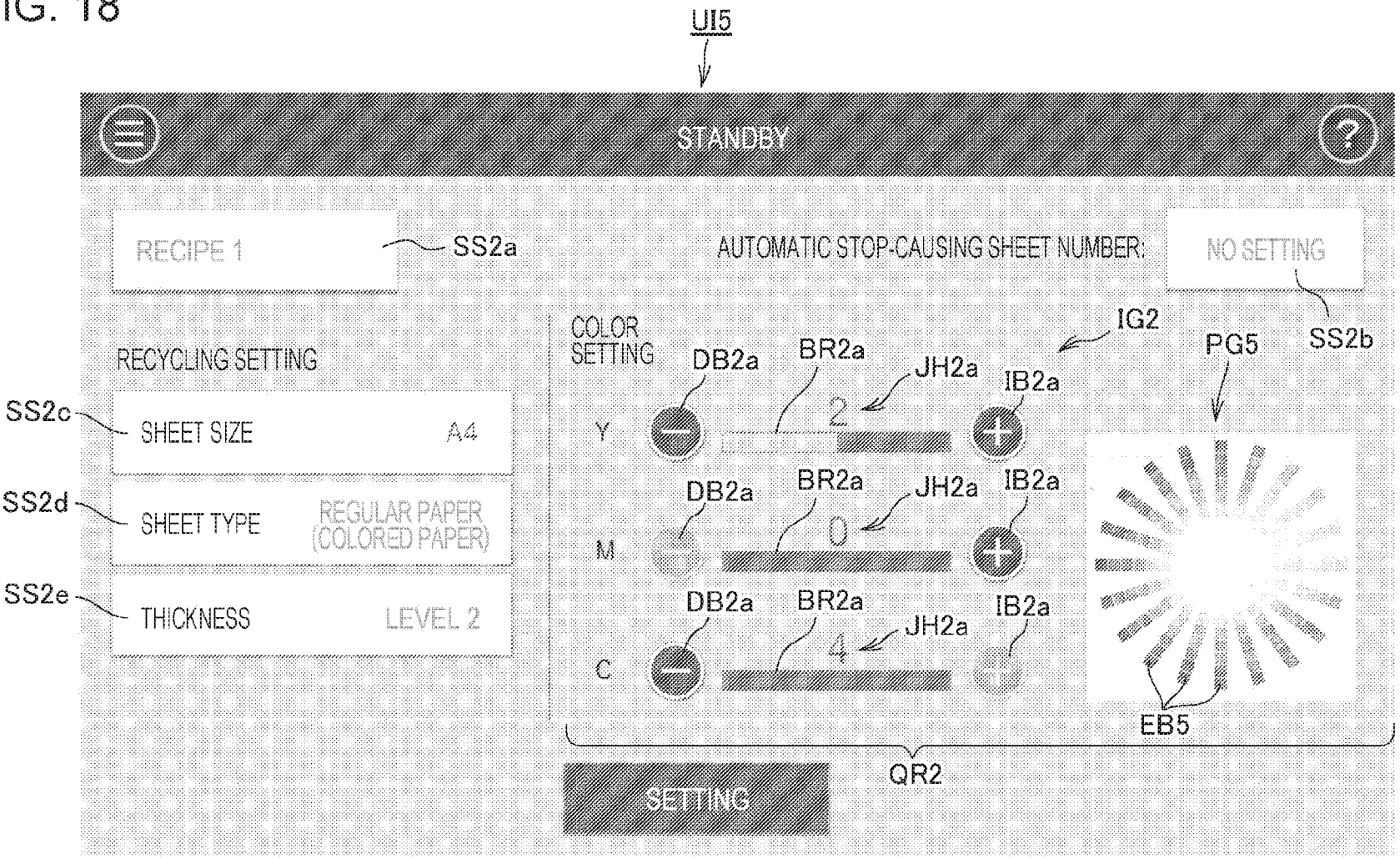
FIG. 18 is a view showing a fifth user interface.

FIG. 18 is a view showing a fifth user interface UI5 which is the second modification example of the second user interface UI2. In the fifth user interface UI5 in FIG. 18, the same reference signs are assigned to the same configurational elements as those in the second user interface UI2 in FIG. 10, and thus the description thereof is omitted.

As clarified in a comparison between FIG. 18 and FIG. 10, on the fifth user interface UI5 shown in FIG. 18, a color palette image PG5 is displayed, instead of the color selecting buttons EB2*a* to EB2*f* on the second user interface UI2.

As shown in FIG. 18, the color pallet image PG5 has rectangular color selecting buttons EB5 that are radially expanded depending on the hue, the brightness, and the chromaticness with respect to a plurality of colors. Each of the color selecting buttons EB5 is a touch operating button.

The user conducts the touch operation on any one of the color selecting buttons EB5 of the color pallet image PG5, and thereby being able to select the color of the sheet to be manufactured by the sheet manufacturing apparatus 100. When an operation on any one touch operating button of the color selecting buttons EB5 is detected, the controller 150 adjusts the yellow value, the magenta value, and the cyan value automatically such that the color of the sheet to be manufactured is a color approximate to a color corresponding to the touch-operated color selecting button EB5. In addition, the controller 150 causes the color bars BR2*a* and the information JH2*a* to have information obtained by reflecting the automatically adjusted yellow value, magenta value, and cyan value.

The fifth user interface UI5 is provided, and thereby the same effects as those of the second user interface and the fourth user interface UI4 are achieved.

In addition, regarding the fifth user interface UI5, similarly to the fourth user interface UI4, in a case where the user selects a color that is not suitable for printing by using the color pallet image PG5, the controller 150 may be configured to display a warning indicating that the color is not suitable for the printing on the fifth user interface UI5. In addition, a configuration may be employed, in which a button corresponding to a color suitable for the printing of the color selecting buttons EB5 of the color pallet image PG5 is displayed along with information indicating that the color is suitable, in advance. In addition, in a case of selecting a color for which it is not possible for the resin to be supplied in accordance with the second rule, the controller 150 may be configured to notify the user that the resin is not supplied.

Modification Example 3

Next, a third modification example (Modification example 3) of the second user interface UI2 will be described.

Figure 19:
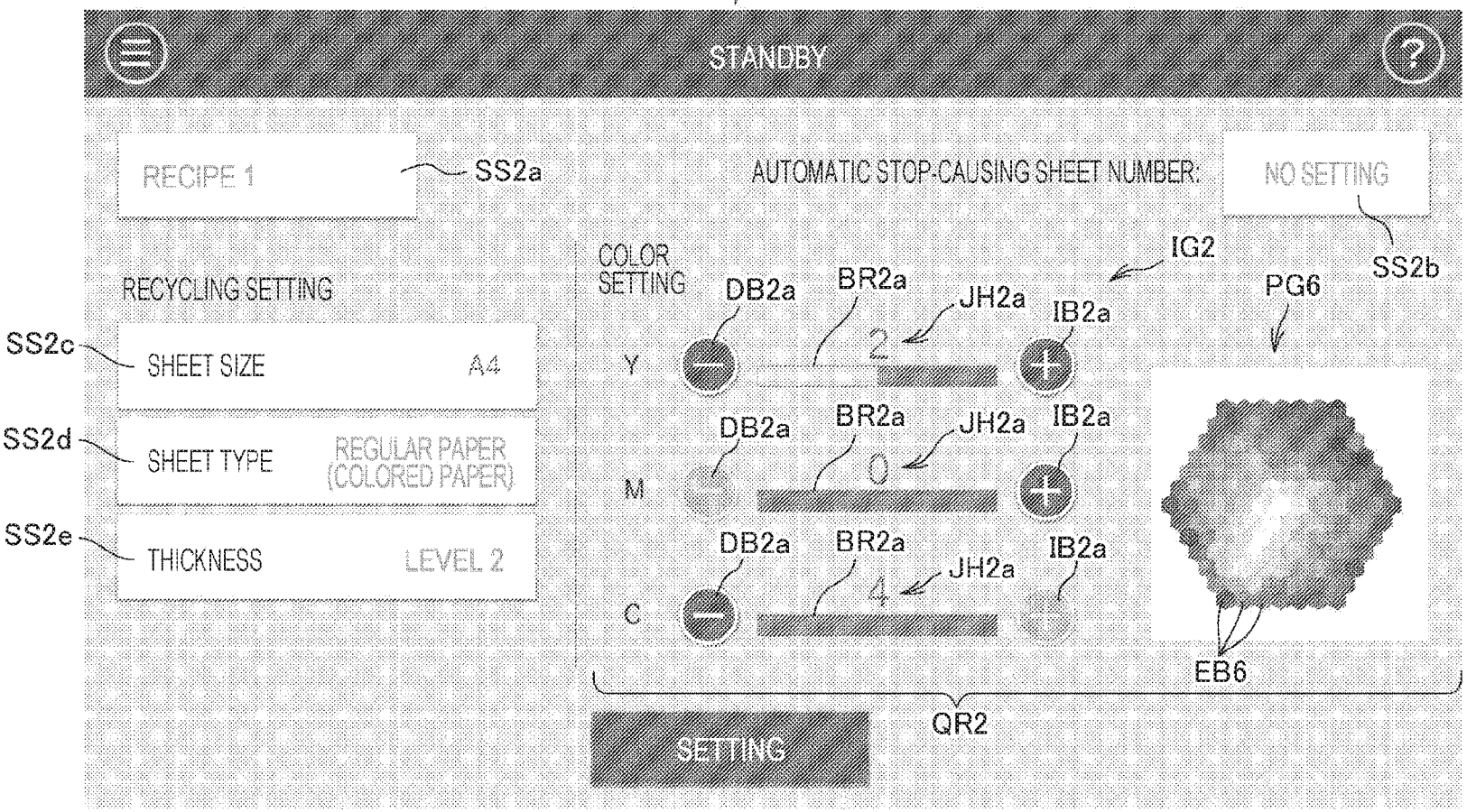
FIG. 19 is a view showing a sixth user interface.

FIG. 19 is a view showing a sixth user interface UI6 which is the third modification example of the second user interface UI2. In the sixth user interface UI6 in FIG. 19, the same reference signs are assigned to the same configurational elements as those in the second user interface UI2 in FIG. 10, and thus the description thereof is omitted.

As clarified in a comparison between FIG. 19 and FIG. 10, on the sixth user interface UI6 shown in FIG. 19, a color palette image P06 is displayed, instead of the color selecting buttons EB2*a* to EB2*f* on the second user interface UI2.

As shown in FIG. 19, the color pallet image PG6 has regular hexagonal color selecting buttons EB6 that are disposed to be adjacent to each other in a predetermined state within a regular hexagonal frame depending on the hue, the brightness, and the chromaticness with respect to a plurality of colors. Each of the color selecting buttons EB6 is a touch operating button.

The user conducts the touch operation on any one of the color selecting buttons EB6 of the color pallet image PG6, and thereby being able to select the color of the sheet to be manufactured by the sheet manufacturing apparatus 100. When an operation on any one touch operating button of the color selecting buttons EB6 is detected, the controller 150 adjusts the yellow value, the magenta value, and the cyan value automatically such that the color of the sheet to be manufactured is a color approximate to a color corresponding to the touch-operated color selecting button EB6. In addition, the controller 150 causes the color bars BR2*a* and the information JH2*a* to have information obtained by reflecting the automatically adjusted yellow value, magenta value, and cyan value.

The sixth user interface UI6 is provided, and thereby the same effects as those of the second user interface, the fourth user interface UI4, and the fifth user interface UI5 are achieved.

In addition, regarding the sixth user interface UI6, similarly to the fourth user interface UI4, in a case where the user selects a color that is not suitable for printing by using the color pallet image PG6, the controller 150 may be configured to display a warning indicating that the color is not suitable for the printing on the sixth user interface UI6. In addition, a configuration may be employed, in which a button corresponding to a color suitable for the printing of the color selecting buttons EB6 of the color pallet image PG6 is displayed along with information indicating that the color is suitable, in advance. In addition, in a case of selecting a color for which it is not possible to supply the resin in accordance with the second rule, the controller 150 may be configured to notify the user that the resin is not supplied.

The embodiment described above represents only an aspect of the invention, and it is possible to optionally modify and apply the embodiment within a range of the technical idea of the invention.

For example, in the embodiment described above, regarding the recipe, a configuration is employed, in which the user selects any one of level 1 to level 10 registered in advance, and the recipe selected by the user is used in the process according to manufacturing of the sheet. In this respect, a configuration may be employed, in which the user is able to temporarily register the recipe that is used in the process related to manufacturing of a series of sheets, and the process related to the manufacturing of a series of sheets is executed by using the temporarily registered recipe.

In the embodiment described above, a configuration may be employed, in which the controller 150 determines the target rotation amount (the supply amount of resin) of the screw feeder SF corresponding to each color by using the first supply amount table TB1 and the second supply amount table TB2. However, a configuration may be employed, in which the controller 150 determines the target rotation amount (the supply amount of resin) of the screw feeder SF corresponding to each color by using a calculation expression in advance based on the various setting values.

In addition, in the embodiment described above, the controller 150 adjusts the rotation amount (rotation speed per unit time) of the screw feeder SF corresponding to each color, thereby, adjusting an amount of each colored resin that is supplied in the resin supply process. In this respect, the controller 150 may be configured to adjust the supply amount of the resin through the following method. In other words, regarding the screw feeder SF corresponding to each color, the controller 150 acquires a constant rotation speed per unit time when the screw feeder SF rotates. The controller 150 adjusts a total time during which the screw feeder SF rotates in a predetermined period, thereby adjusting the supply amount of the resin. For example, in a case where a predetermined period is "100", the controller 150 causes the screw feeder SF related to one color and the screw feeder SF corresponding to another color to rotate or stop appropriately such that a total time, during which the screw feeder SF related to one color rotates, becomes "80", and a total time, during which the screw feeder SF related to the other color rotates, becomes "30" such that each of the screw feeders SF is controlled to convey an appropriate amount of resin. Even in this configuration, the controller 150 is capable of supplying an appropriate amount of resin depending on various setting values in the resin supply process.

For example, in the embodiment described above, the controller 150 may be configured to display a user interface or another screen on the touch panel H5 provided in the sheet manufacturing apparatus 100. However, the controller 150 may be configured to communicate with an external device and to display a user interface on the external device.

In addition, in the embodiment described above, a configuration is described, in which a sheet before being cut is cut in a cutting step of the sheet so as to manufacture a sheet having a predetermined size; however, a configuration may be employed, in which the sheet before being cut is wound around a winding roller.

In addition, at least some of the functional blocks shown in the figure may be realized as hardware or may be realized in cooperation with the hardware and software, and the embodiment is not limited to a configuration of disposing independent hardware resources as shown in the drawings. In addition, a program that is executed by the controller 150 may be stored in the non-volatile storage unit or another storage device (not shown). In addition, a configuration may be employed, in which a program stored in the external device may be acquired via the communication portion so as to be executed.

REFERENCE SIGNS LIST

52 resin supply unit
100 sheet manufacturing apparatus
120 nonvolatile storage unit
121 setting data
150 controller
352*a* to 352*f* resin supply motor
508*a* to 508*f* screw feeder
510*a* to 510*f* resin conveying unit
TB1 first supply amount table
TB2 second supply amount table

The invention claimed is:

1. A sheet manufacturing apparatus configured to manufacture a sheet having a predetermined color, the apparatus comprising:

a plurality of resin cartridges that store a plurality of resins with colors, respectively, the plurality of resin cartridges including a first resin cartridge that stores an uncolored resin which is not colored, and at least one second resin cartridge that stores a colored resin which is a resin that is colored;

a resin supply unit that supplies resins from the plurality of resin cartridges to a predetermined raw material in a predetermined step of manufacturing the sheet; and a controller that selects the first resin cartridge and the at least one second resin cartridge together as supply sources of the resins, when the resin supply unit supplies the resins, and performs setting related to a supply amount of a resin for each of the selected resin cartridges, based on setting related to a color of the sheet to be manufactured, the controller performing setting related to a total supply amount of the resins, which are supplied from the selected resin cartridges, relative to a weight of the predetermined raw material, subtracting a total of a supply amount of the colored resin supplied from the at least one second resin cartridge from the total supply amount of the resins supplied from the selected resin cartridges, and setting a supply amount obtained by the subtracting to be a supply amount of the uncolored resin supplied from the first resin cartridge.

2. The sheet manufacturing apparatus according to claim 1, wherein, when performing the setting related to the supply amount of the resin for each of the selected resin cartridges, the controller determines the total supply amount of all of the resins such that a ratio of the total supply amount of all of the resins to the weight of the predetermined raw material does not exceed a first threshold value.

3. The sheet manufacturing apparatus according to claim 2, wherein the controller determines each of supply amounts of resins that have respective colors and are supplied from the second resin cartridges, such that a ratio of a supply amount of a colored resin that has one color and is supplied from each of the second resin cartridges to the determined total supply amount of all of the resins does not exceed a second threshold value, and wherein the controller determines, as the supply amount of the uncolored resin supplied from the first resin cartridge, an amount corresponding to a difference between the determined total supply amount of all of the resins and a total of the determined supply amounts of the resins that have respective colors and are supplied from the second resin cartridges.

4. The sheet manufacturing apparatus according to claim 1, wherein the controller displays a user interface for performing setting related to the color of the sheet to be manufactured.

5. The sheet manufacturing apparatus according to claim 4, wherein the controller displays the user interface that has a touch operating button for adjusting the supply amount for each color of the second resin cartridges, and wherein the controller selects the resin cartridges, which are the supply sources of the resins, when the resin supply unit supplies the resin, and performs setting related to a supply amount of a resin for each of the selected resin cartridges, based on an operation performed through the touch operating button.

6. The sheet manufacturing apparatus according to claim 5, wherein the controller does not display the touch operating button for adjusting the supply amount of the uncolored resin in the user interface.

7. The sheet manufacturing apparatus according to claim 4, wherein the controller displays the user interface that has a touch operating button for displaying a selectable color of the sheet to be manufactured, and wherein the controller selects the resin cartridges, which are the supply sources of the resins, when the resin supply unit supplies the resin, and performs setting related to the supply amount of the resin for each of the selected resin cartridges, based on an operation performed through the touch operating button.

8. The sheet manufacturing apparatus according to claim 1, wherein the resin supply unit has a resin conveying unit that conveys a resin to a supply destination for each resin cartridge, and wherein the controller controls the resin conveying unit based on the setting related to the supply amount of the resin for each of the resin cartridges.

9. The sheet manufacturing apparatus according to claim 8, wherein the resin conveying unit has a screw feeder, and wherein the controller controls a rotation speed of the screw feeder provided in the resin conveying unit based on the setting related to the supply amount of the resin for each of the resin cartridges.

* * * * *